US011817234B2

(12) United States Patent
Kumar et al.

(10) Patent No.: US 11,817,234 B2
(45) Date of Patent: Nov. 14, 2023

(54) WIRING HARNESS ASSEMBLY

(71) Applicant: iLux electric (Cablage Kumar Inc.), Disraeli (CA)

(72) Inventors: Rajeev Kumar, Disraeli (CA); Rakesh Kumar, Disraeli (CA)

(73) Assignee: iLux electric (Cablage Kumar Inc.), Thetford Mines (CA)

( * ) Notice: Subject to any disclaimer, the term of this patent is extended or adjusted under 35 U.S.C. 154(b) by 151 days.

(21) Appl. No.: 17/121,311

(22) Filed: Dec. 14, 2020

(65) Prior Publication Data

US 2022/0037061 A1 Feb. 3, 2022

Related U.S. Application Data

(63) Continuation of application No. 16/983,501, filed on Aug. 3, 2020.

(51) Int. Cl.
*H01B 13/012* (2006.01)

(52) U.S. Cl.
CPC . *H01B 13/01209* (2013.01); *H01B 13/01236* (2013.01)

(58) Field of Classification Search
CPC ..... H01B 13/01209; H01B 13/01236
See application file for complete search history.

(56) References Cited

U.S. PATENT DOCUMENTS 3,259,968 A * 7/1966 Dyksterhouse ..... G01R 31/67 174/72 A
3,859,724 A * 1/1975 Folkenroth ..... H01R 43/01 29/760
4,114,014 A * 9/1978 Shogo ..... H01R 43/0249 228/904
4,950,168 A 8/1990 Watanabe et al.
5,501,605 A 3/1996 Ozaki et al.
5,895,889 A * 4/1999 Uchida ..... B60R 16/0207 174/72 A
7,841,911 B2 11/2010 Aizawat
7,867,001 B2 1/2011 Ambo et al.
(Continued)

FOREIGN PATENT DOCUMENTS

CA 3071499 A1 2/2019
EP 3575155 A1 * 12/2019 ..... B60R 16/0215
JP 2003317555 A * 11/2003

*Primary Examiner* — Peter Dungba Vo
*Assistant Examiner* — Jose K Abraham
(74) *Attorney, Agent, or Firm* — PRAXIS

(57) ABSTRACT

There is provided a wiring harness assembly comprising a main trunk cable assembly, a branch cable assembly and at least one connector. The main trunk assembly defines opposite terminal ends and comprises main trunk wires. The branch cable assembly defines opposite terminal ends and comprises branch wires. The connector connects the main trunk cable assembly and the branch cable assembly. The connector comprises an outer housing with an inner wiring harness positioned therein. The wiring harness comprises main trunk wire segments and branch wire segments interconnected at mutual connecting points. The main trunk wire segments define terminal ends connected to the main trunk wires at one of the terminal ends of the main trunk cable assembly. The branch wire segments define terminal ends connected to the branch wires at one of the terminal ends of the branch cable assembly.

11 Claims, 17 Drawing Sheets

(56) References Cited

U.S. PATENT DOCUMENTS

| | | | | |
|---|---|---|---|---|
| 9,457,741 | B2 * | 10/2016 | Sasaki | B60R 16/0207 |
| 10,232,808 | B2 * | 3/2019 | Ogue | H02H 3/087 |
| 10,741,978 | B2 * | 8/2020 | Watanabe | H01R 13/50 |
| 2002/0019165 | A1 * | 2/2002 | Aoki | B60R 16/0207 439/502 |
| 2002/0180271 | A1 * | 12/2002 | Taniguchi | B60R 16/0207 307/10.1 |
| 2009/0241331 | A1 * | 10/2009 | Bedoe | H01B 13/01254 29/825 |
| 2018/0326926 | A1 * | 11/2018 | Osada | B60R 16/0207 |
| 2019/0249600 | A1 * | 8/2019 | Salt | B29C 59/04 |
| 2019/0252092 | A1 * | 8/2019 | Mizuno | B60R 16/0215 |

* cited by examiner

WIRING HARNESS ASSEMBLY

CROSS-REFERENCE TO RELATED APPLICATIONS

The present application claims priority of U.S. patent application Ser. No. 16/983,501 filed on Aug. 3, 2020 and is incorporated herein by reference in its entirety.

TECHNICAL FIELD

The present disclosure generally relates to wiring. More particularly, but not exclusively, the present disclosure relates to a wiring harness assembly and a method of making a wiring harness assembly.

BACKGROUND

Wiring is a well-known practice for the installation of electrical wiring for residential, commercial and/or industrial purposes. The wiring process is often complex with many bundles of interconnected wire networks stacked and/or clamped usually and concealed under accessible structures for future replacement, repair and/or maintenance. In many cases wiring installations require wiring harnesses, connectors, splitters and jointers.

A wire may be a single usually cylindrical, flexible strand or rod of metal or a multistrand of braided rods within a protective sleeve. Wire gauges come in various standard sizes, as expressed in terms of a gauge number (i.e diameter size). A wiring harness is an assembly of electrical wires bound together by a durable material such as rubber, vinyl, electrical tape the like. The wires are first cut to the desired length and they may also be printed on with indicia for being identified. The ends of the wires are stripped (by removing portions of the sleeve) to expose the metal (or core) of the wires, which are fitted with any required terminals or connectors The wires are then assembled and interconnected into a harness and bound together. Connectors are fasteners used to make a tight, low-impedance connection between two or more electrical wires. Made of flame-retardant materials, wire connectors prevent wires from contacting other wires or exposed metal surfaces.

Wire harnesses are used in a variety of industries including and without limitation to the automobile industry, the trailer industry, the telecommunications industry, the medical industry, the aviation industry, the marine and off-road industries etc

OBJECTS

An object of the present disclosure is to provide a wire harness assembly.

An object of the present disclosure is to provide a method of making a wire harness assembly.

An object of the present disclosure is to provide a kit for a wire harness assembly.

SUMMARY

In accordance with an aspect of the present disclosure, there is provided a wiring harness assembly comprising: a main trunk cable assembly defining opposite terminal ends thereof and comprising main trunk wires; a branch cable assembly defining opposite terminal ends thereof and comprising branch wires; and at least one connector for connecting the main trunk cable assembly and the branch cable assembly, the connector comprising an outer housing and an inner wiring harness positioned within the housing, the wiring harness comprising main trunk wire segments and branch wire segments interconnected at mutual connecting points thereof, the main trunk wire segments defining terminal ends thereof for being connected to the main trunk wires at one of the terminal ends of the main trunk cable assembly, the branch wire segments defining terminal ends thereof for being connected to the branch wires at one of the terminal ends of the branch cable assembly.

In an embodiment, the housing defines a main portion and arm portions extending therefrom defining free ends, the terminal ends of the of the main wire segments and the branch wire segments being positioned at respective free rends of the arm portions.

In an embodiment, the connector and the respective terminal ends of the of main trunk cable assembly and the branch cable assembly connected thereto are sealed together by a heat shrinking tube.

In an embodiment, the connector and the respective terminal ends of the of main trunk cable assembly and the branch cable assembly connected thereto are further connected by a clamping device comprising a shell body defining a pair or hinged body parts releasably connectable together for locking therebetween the respective terminal ends and the connector.

In an embodiment, the main trunk cable assembly comprises at least two separate main trunk cable portions, each of the main trunk cable portions defining respective terminal ends thereof and comprising respective ones of the main trunk wires, the connector providing for connecting the at least two main trunk cable portions, the main trunk wire segments defining opposite ones of the terminal ends thereof for being respectively connected to the main trunk wires of each of the main trunk cable portions at respective terminal ends thereof. In an embodiment, the main trunk cable assembly comprises a plurality of the separate main trunk cable portions and a plurality of the connectors, at least one of the connectors of the plurality being positioned between a pair of adjacent main trunk cable portions for interconnection therewith. In an embodiment, the plurality of separate main trunk cable portions and the plurality of the connectors are coded with indicia for indicating a position thereof within the wiring harness assembly.

In an embodiment, the branch cable assembly comprises at least two separate branch cable portions, each of the branch cable portions defining respective terminal ends thereof and comprising respective ones of the branch wires, the connector providing for connecting the at least two branch cable portions, the branch wire segments defining opposite ones of the terminal ends thereof for being respectively connected to the branch wires of each of the branch cable portions at respective terminal ends thereof. In an embodiment, the branch cable assembly comprises a plurality of the separate branch cable portions and a plurality of the connectors, at least one of the connectors of the plurality being positioned between a pair of adjacent branch cable portions for interconnection therewith. In an embodiment, the plurality of separate branch cable portions and the plurality of the connectors are coded with indicia for indicating a position thereof within the wiring harness assembly.

In an embodiment, the main trunk cable assembly comprises a plurality of aligned main trunk cables running along a same pathway.

In an embodiment, the branch cable assembly comprises a plurality of aligned branch cables running along a same pathway.

In an embodiment, the at least one of the main trunk cable assembly and the branch cable assembly comprises on at least a part thereof an external corrugated jacket integrated thereto.

In accordance with an aspect of the present disclosure, there is provided a method of making a wiring harness assembly, the method comprising: preparing a visual representation of a wiring harness diagram comprising: providing a main trunk of main trunk wires running along a same pathway and one or more branches or branch wires extending from the main trunk at one or more attachment sections along the main trunk, the main trunk wires and the branch wires being connected at connecting points within one or more attachment sections; delimiting one or more intersections along the main trunk, each of the intersections comprising a respective one of the one or more attachment sections and a plurality of proximal portions, at least one of the plurality of proximal portions comprising a portion of the main trunk contiguous with the attachment section, at least another one of the plurality of proximal portions comprising a portion of the branch contiguous with the attachment section; grouping the main trunk wires to define a main trunk cable defining a terminal end thereof at one of the proximal portions; grouping the branch wires of each branch to define a respective branch cable, each respective branch cable defining a respective terminal end thereof at a respective one of the proximal portions; providing a connector for each of the intersections for housing therein the attachment points and providing terminal ends at the proximal portions for connecting to the terminal ends of the main trunk cable at of the respective branch cables; and molding connectors, each of the connectors comprising with respective segments of interconnected main trunk wires and branch wires and defining terminal ends for connecting to cables in accordance with the wiring diagram; preparing main trunk cables and branch cables in accordance with wiring harness diagram; assembling and connecting the connectors, the main trunk cables and the branch cables in accordance with the wiring harness diagram.

In an embodiment, the method further comprises providing the connectors, the main trunk cables and the branch cables with indicia for indicating their respective positions within the wiring harness assembly for being interconnected in accordance with their respective positions.

In an embodiment, the method further comprises heat sealing connections between the connectors, the main cables and the branch cables.

In an embodiment, the method further comprises clamping connections between the connectors, the main cables and the branch cables.

In an embodiment, the method further comprises extruding a corrugated outer jacket on at least one of the main trunk cables or the branch cables.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Generally stated and in accordance with an aspect of the present disclosure, there is provided a wiring harness assembly comprising a main trunk cable assembly, a branch cable assembly and at least one connector. The main trunk assembly defines opposite terminal ends thereof and comprises main trunk wires. The branch cable assembly defines opposite terminal ends thereof and comprises branch wires. The at least one connector provides for connecting the main trunk cable assembly and the branch cable assembly. The connector comprises an outer housing and an inner wiring harness positioned within the housing. The wiring harness comprises main trunk wire segments and branch wire segments interconnected at mutual connecting points thereof. The main trunk wire segments defines terminal ends thereof for being connected to the main trunk wires at one of the terminal ends of the main trunk cable assembly. The branch wire segments defines terminal ends thereof for being connected to the branch wires at one of the terminal ends of the branch cable assembly.

With reference to the drawings non-limiting illustrative embodiments will now be described so as to exemplify the disclosure and not limit the scope thereof.

Figure 1:
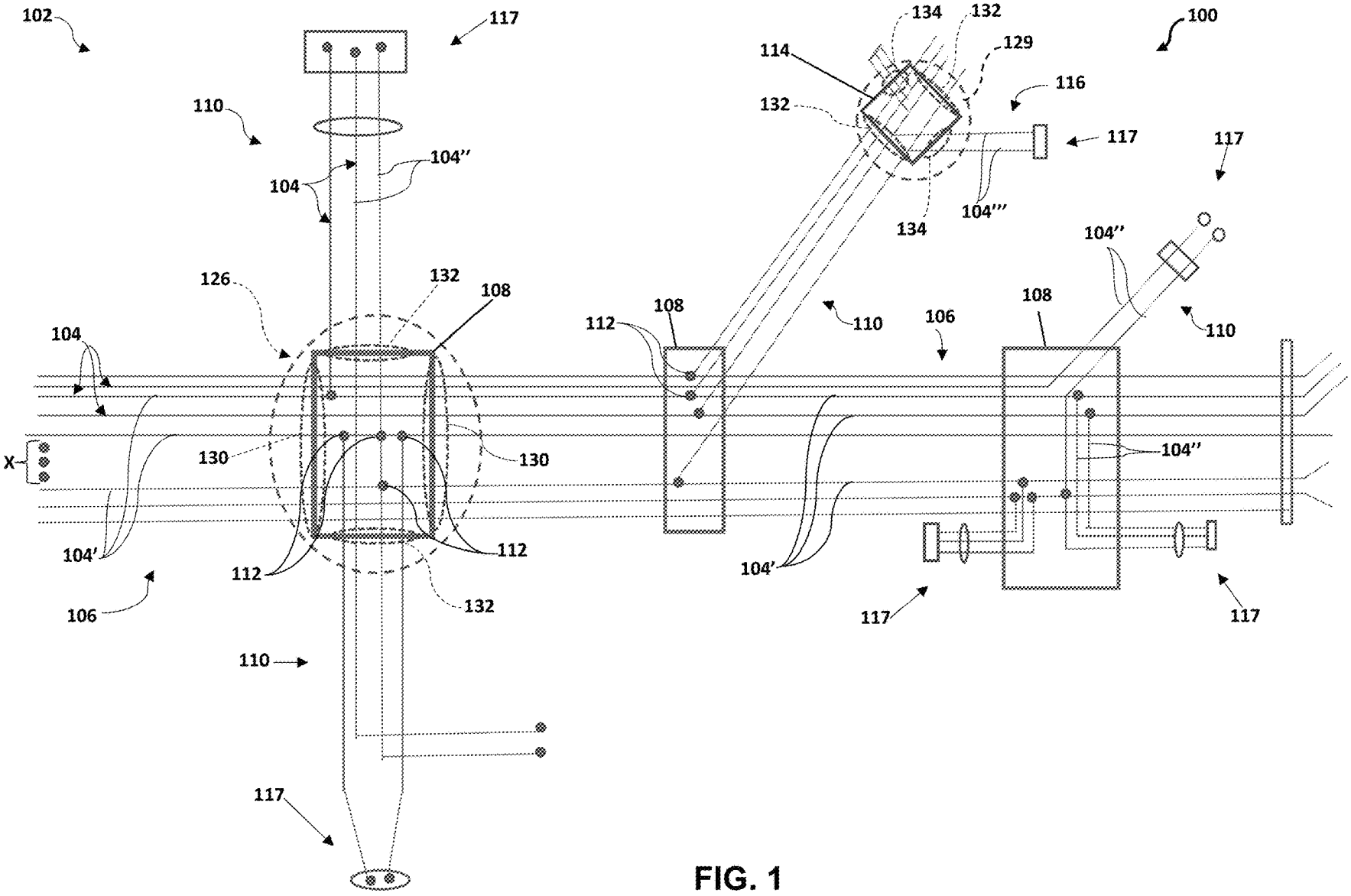
FIG. 1 shows a visual representation of a wiring diagram comprising a wiring harness assembly including main trunk wires, branch wires and attachments therebetween in accordance with a non-restrictive illustrative embodiment of the present disclosure.

FIG. 1 shows a visual representation of a wiring diagram 100 comprising a wiring harness assembly 102 of a plurality of wires, generally denoted by reference numeral 104. A wire is usually a single conductor and a cable is group of conductors (or wires). Wires/cables are made of a common material- copper or aluminum. Wires may be bare or coated with a protective layer. A wire is usually twisted. Cables can include one insulated wire or a group of wires within a protective casing.

The wiring diagram 100 is prepared based on customer requirements including provided engineering drawings (or preliminary customer wiring diagrams). Wiring diagrams provided by customers are usually simple visual representations of the physical connections and physical layout of an electrical system or circuit. These diagrams show how the electrical wires are interconnected and can also show where fixtures and components may be connected to the overall system. Customer drawings include various wires/cables which may have various gauges and/or sizes and being connected to other such wires cables at various connection points to provide a network of wires according to the engineering requirements. It is based on the drawings, requirements, desires and the like that the wiring diagram 100 is prepared.

The wiring diagram 100 comprises a main trunk 106 with identified branch attachment sections or areas 108. A branch attachment section 108 is a section on the main trunk 106 on which branches 110 are attached to. The main trunk 106 comprises main trunk wires 104'. Each branch 110 comprises respective branch wires 104" which are connected to the wires 104' of each attachment section 108 at connecting points 112 with respective ones of the wires 104'. Depending on the customer requirements of the overall wring network to be produced, a branch 110 can also have one or more sub-branch attachment sections 114 along its length. A sub-branch attachment section 114 is a section on a branch 110 on which sub-branches 116 are attached to. A sub-branch 116 comprises sub-branch wires 104'''. The sub-branch wires 104''' are connected to the branch wires 104" of a sub-branch attachment section 114.

The main trunk 106, the branches 110 and/or the sub-branches 116 can be connected to a variety of electrical components 117 as is will be understood by the skilled artisan.

Figure 2:
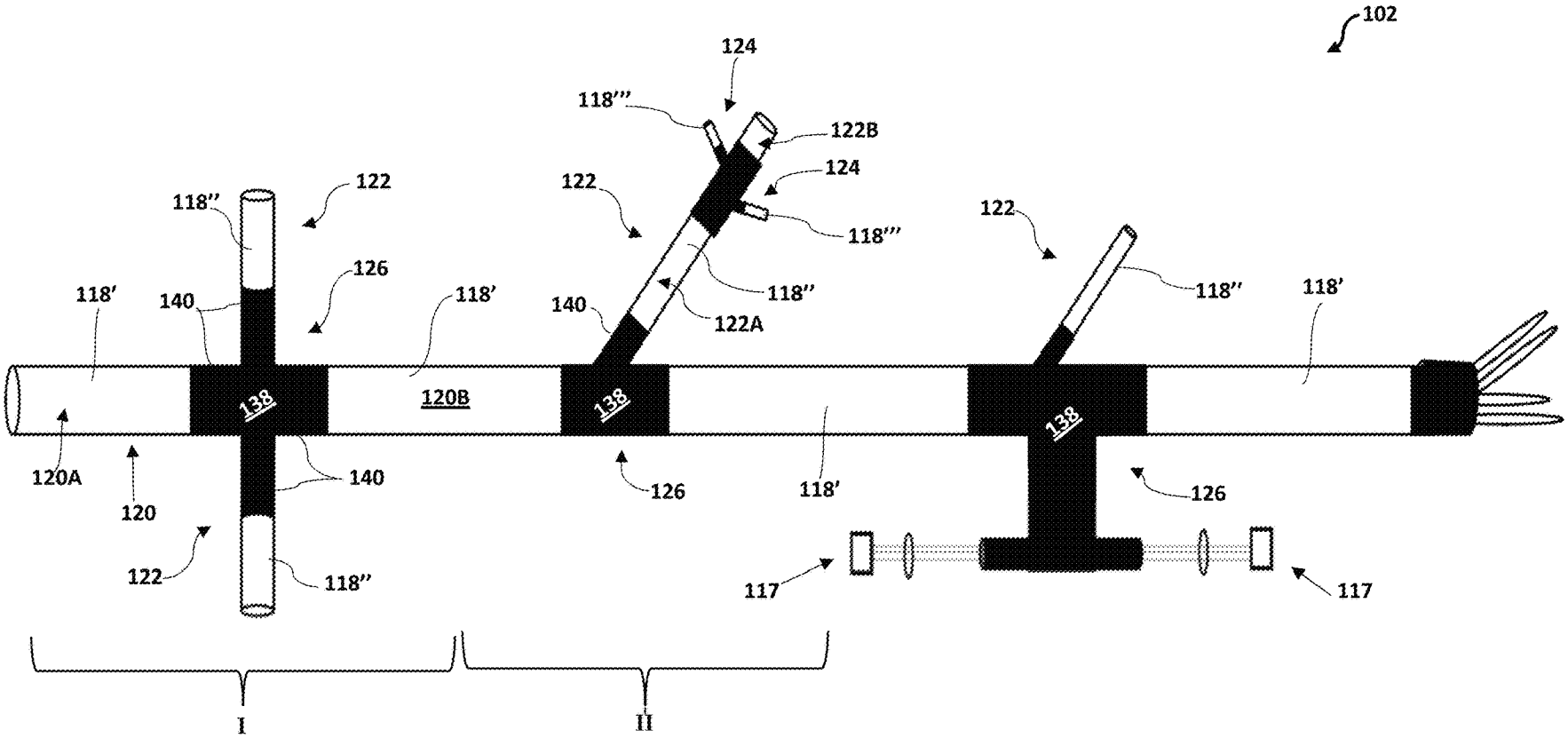
FIG. 2 shows a wiring harness assembly including main trunk cables, branch and sub-branch cables and connectors therebetween in accordance with a non-restrictive illustrative embodiment of the present disclosure.

With respect to FIGS. 1 and 2, the main wires 104' of the main trunk 106 run generally along the same path and these wires 104' are grouped together to be fitted within a common jacket 118' forming a main cable 120. The respective branch wires 104" of a given branch 110 are grouped together and fitted within a common jacket 118" forming a branch cable generally denoted 122. The respective sub-branch wires 104''' of a given sub-branch 116 are grouped together and fitted within a common jacket 118''' forming a sub-branch cable generally denoted 124.

With reference to both FIGS. 1 and 2, connectors 126 provide for covering intersections 128 along the main trunk 106 shown in FIG. 1. An intersection 128 comprises an attachment section 108 as well as proximal portions 130 of the wires 104" of a branch 110 at or extending from the attachment section 108 and the proximal portions 132 of the wires 104' of the main trunk 106. The connector 126 has a main body portion 138 covering the attachment section 108 (shown in FIG. 1) and arms 140 for covering the proximal portions 130 and 132 (shown in FIG. 1). Arms 140 are sleeve like elements which can also be considered as the branches of the connector 126.

In an embodiment, a main trunk cable 122 is an assembly of several main trunk portion cables interconnected along the main trunk 106 via connectors 126 positioned at intersections 128.

With reference to both FIGS. 1 and 2, the connector 126 also provides for covering an intersection 129 along the length of the branch 110. An intersection 129 comprises an attachment section 114 as well as proximal portions 132 of the wires 104" of a branch 110 at or extending from the attachment section 108 and the proximal portions 134 of the wires 104'" of the sub-branch 116. The connector 126 has a main body portion 138 covering the attachment section 114 and arms 140 for covering the proximal portions 132 and 134. Of course, intersections 128 need not include branches 110.

In an embodiment, a branch cable 122 is an assembly of several branch portion cables interconnected along the same branch 110 via connectors 126 positioned at intersections 129. Of course, intersections 129 need not include branches 116.

In an embodiment and with reference to FIGS. and 3, a main cable 120 is an assembly of interconnected main trunk portion cable 120A and 120B connected to the same branch connector 126*i* positioned therebetween and this connector 126*i* also branches out to branch cables 122' and 122".

In an embodiment and with reference to FIGS. and 3, a branch cable 122 is an assembly of interconnected branch portion cables 122A and 122B connected to the same branch connector 126*ii* positioned therebetween and this connector 126*ii* branches out to sub-branch cables 124' and 124".

Figure 3:
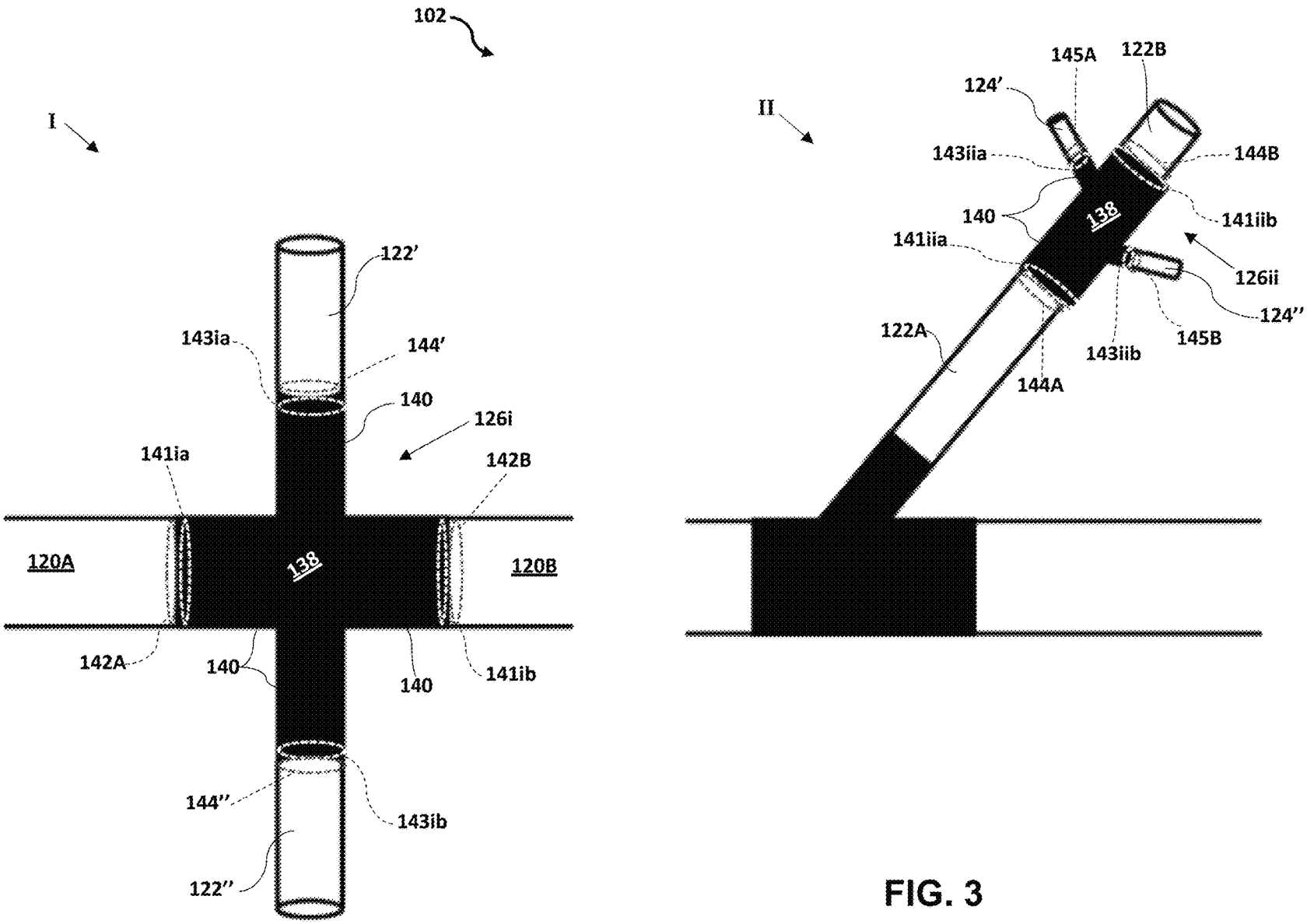
FIG. 3 is an enlarged view of portions I and II of FIG. 2.

Turning now to FIG. 3 which shows enlarged views of portions I and II of the wire harnessing assembly 102 of FIG. 2, the main trunk portion cables 120A and 120B, in accordance with a non-limiting embodiment, are provided with respective terminal ends 142A and 142B for being respectively removably connected to the terminal ends 141*ia* and 141*ib* of respective arms 140 of the connector 126*i* for end to end wire connection as is known in the art. Indeed, the coupled pairs of terminal ends 142A-141*ia* and 142B-141*ib* refer to the proximal portions 130 of the intersection 128 along the main trunk 106 of FIG. 1.

The branch cables 122' and 122" have respective terminal ends, 144' and 144" for being respectively removably connected to the terminal ends 143*ia* and 143*ib* of respective arms 140 of the connector 126*i* for end to end wire connection. Indeed, the coupled pairs of terminal ends 144'-143*ia* and 144"-143*ib* refer to the proximal portions 132 of the intersection 128 along the main trunk 106 of FIG. 1.

The branch portion cables 122A and 122B have respective terminal ends, 144A and 144B for being respectively removably connected to the terminal ends 141*iia* and 141*iib* of respective arms 140 of the connector 126*ii* for end to end wire connection. Indeed, the coupled pairs of terminal ends 144A-141*iia* and 144B-143*iib* refer to the proximal portions 132 of the intersection 129 along the branch 110 of FIG. 1.

The sub-branch cable 124' and 124" have respective terminal ends, 145A and 145B for being respectively removably connected to the terminal ends 143*iia* and 143*iib* of respective arms 140 of the connector 126*ii* for end to end wire connection. Indeed, the coupled pairs of terminal ends 145A-143*iia* and 145B-143*iib* refer to the proximal portions 134 of the intersection 129 along the branch 110 of FIG. 1.

Thus, the main portion cables 120A or 120B or the branch cables 122' or 122" may be selectively disconnected from the connector 126*i* for replacement of any one of the foregoing components. Moreover, the branch portion cables 122A or 122B or the sub-branch cables 124' or 124" may be selectively disconnected from the connector 126*ii* for replacement of any one of the foregoing components.

In an embodiment, the components 120A, 120B, 122', 122", 126*i*, 122A, 122B, 124', 124", and 126*ii* are provided with indicia or color coding based on an assembly map to facilitate reassembly when replacing or repairing components.

Figure 4:
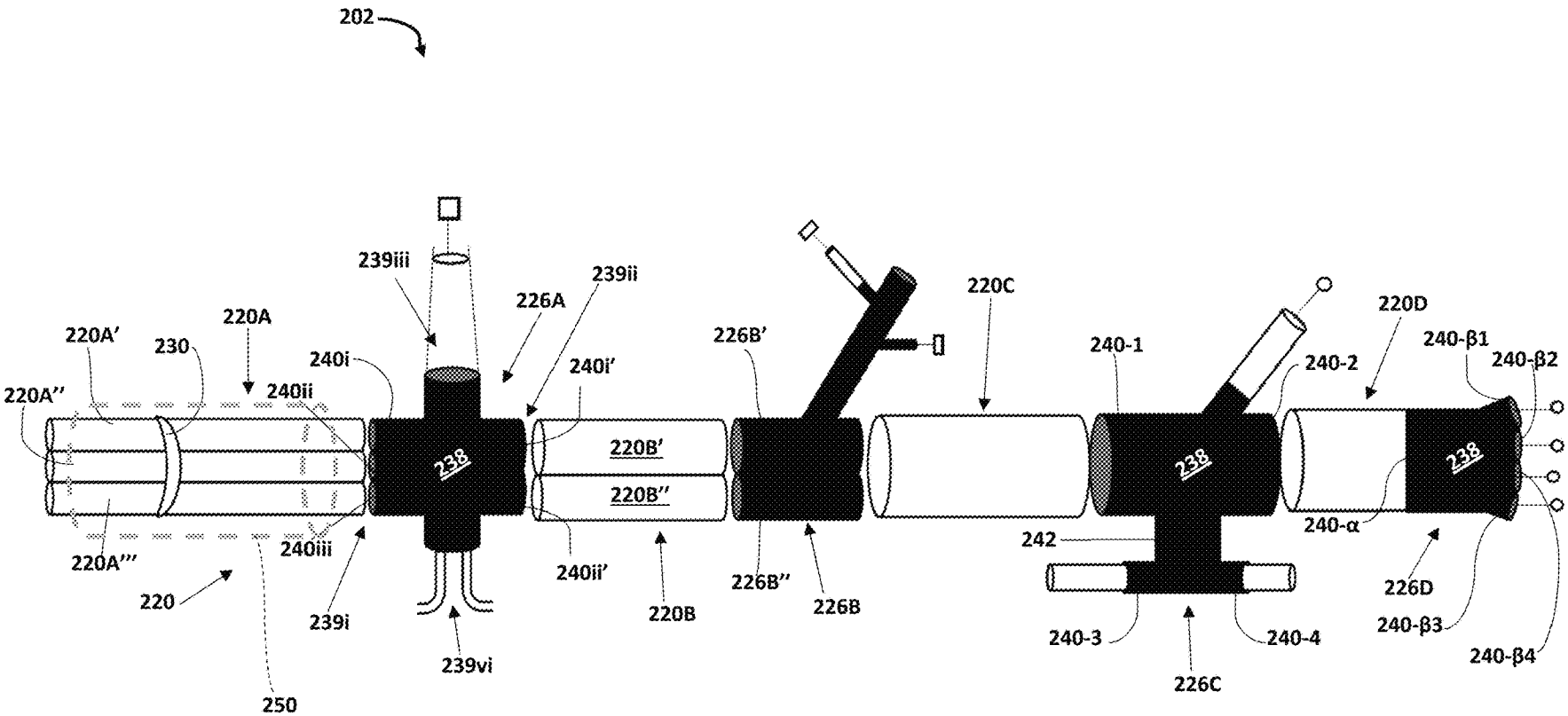
FIG. 4 shows a wiring harness assembly including main trunk cables, branch and sub-branch cables and connectors therebetween in accordance with a non-restrictive illustrative embodiment of the present disclosure.

Turning to FIG. 4, there is shown another example of a wire harness assembly 202, including a main trunk cable assembly 220 comprising a plurality of separate main cable portions namely cables 220A, 220B, 220C and 220D. In this example, cable 220A is an assembly of a plurality of generally aligned separated cables 220A', 220A", 220A'" which can be held together by a clamp 230. In this example, cable portion 220B is an assembly of two large cables, 220B' and 220B", whereas cable portions 220C and 220D are single cables.

Turning briefly to FIG. 1, the part on the wiring diagram 100 identified by the bracket X indicates that a greater or lesser amount of wires 104 can be provided depending on the client needs as explained above. Accordingly, in certain cases it may be convenient to group wires 104 running along the main trunk 106 into several aligned cables as provided in the example of FIG. 4 (i.e. cables 220A', 220A", 220A'" or cables 220B' and 220B").

The wire harness assembly 202 also includes a connector 226A interconnecting cable portions 220 and 220B, a connector 226B interconnecting cable portions 220B and 220C, a connector 226C interconnecting cable portions 220C and 220*d* and a connector 226D connected to cable portion 220D.

Connector 226A includes a main portion 238 defines four sides 239*i*, 239*ii*, 239*iii*, 239*iv*. Three arms 240*i'*, 240*i"*, 240*i'"*, extend from side 239*i* to respectively connect to the three cables 220A', 220A", 220A'". Two arms 240*ii'* and 240*ii"* extend from side 239*ii* to respectively connect to the cables 220B' and 220B".

Connector 226B is an assembly of two stacked and cylindrical connectors 226B' and 226B" which respectively connect to cables 220B' and 220B" at their first common ends thereof and tandemly connect to cable portion 220C at their opposite second common ends thereof. As such, multiple connectors can be used within a main trunk cable connection between two main cables or within branch connection between main cables, branch cables and sub-branch cables as will be understood by the skilled artisan.

Connector 226C has a main portion 238 defining a pair of arms 240-1 and 240-2 an auxiliary portion 242 extending from the main portion 238 and defining a pair of arms. 240-3 and 240-4.

Connector 226D has a main portion 238 defining an arm 240-α at one end thereof and four arms 240-β1, 240-β2, 240-β3, 240-β4.

A separate cable portion 220A can be covered by a jacket 250 which can be directly extruded thereon to be fused directly on the cables 220A', 220A", 220A'" forming a single piece making it convenient to install or replace the single piece 220A in the wire harness 202.

Figure 5:
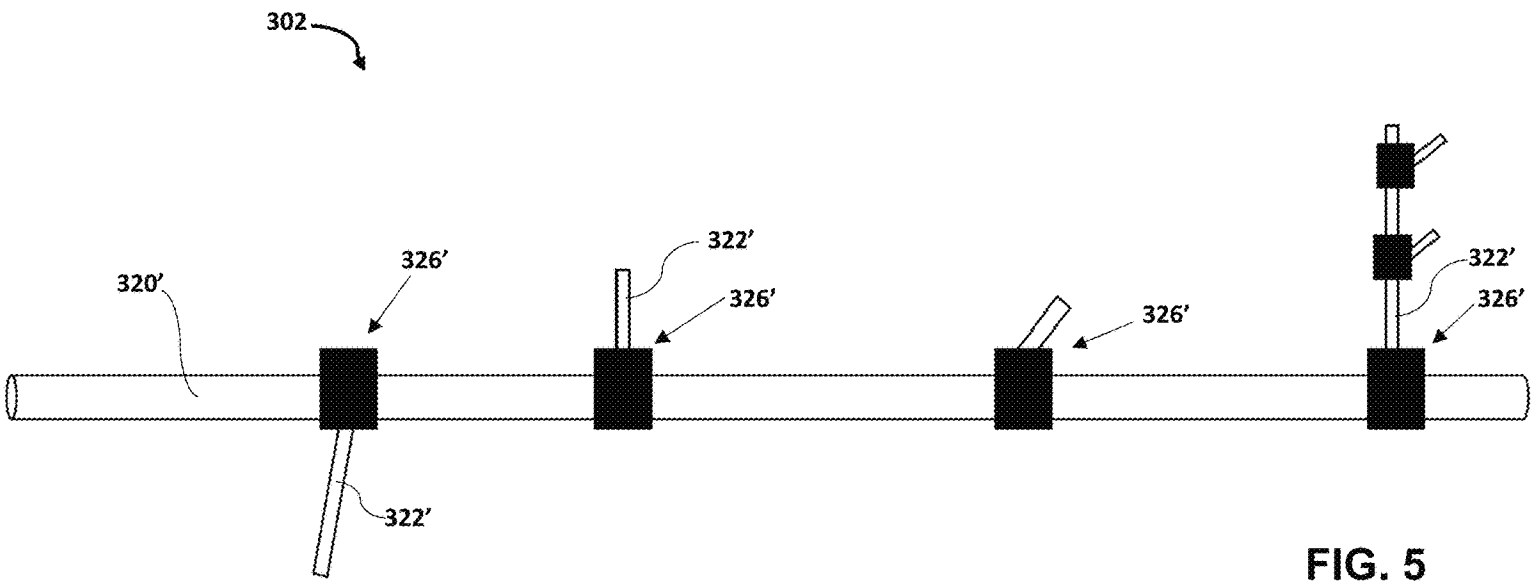
FIG. 5 shows a wiring harness assembly including a main trunk cable line, and branch and sub-branch cables extending therefrom and connectors therebetween in accordance with a non-restrictive illustrative embodiment of the present disclosure.
Figure 6:
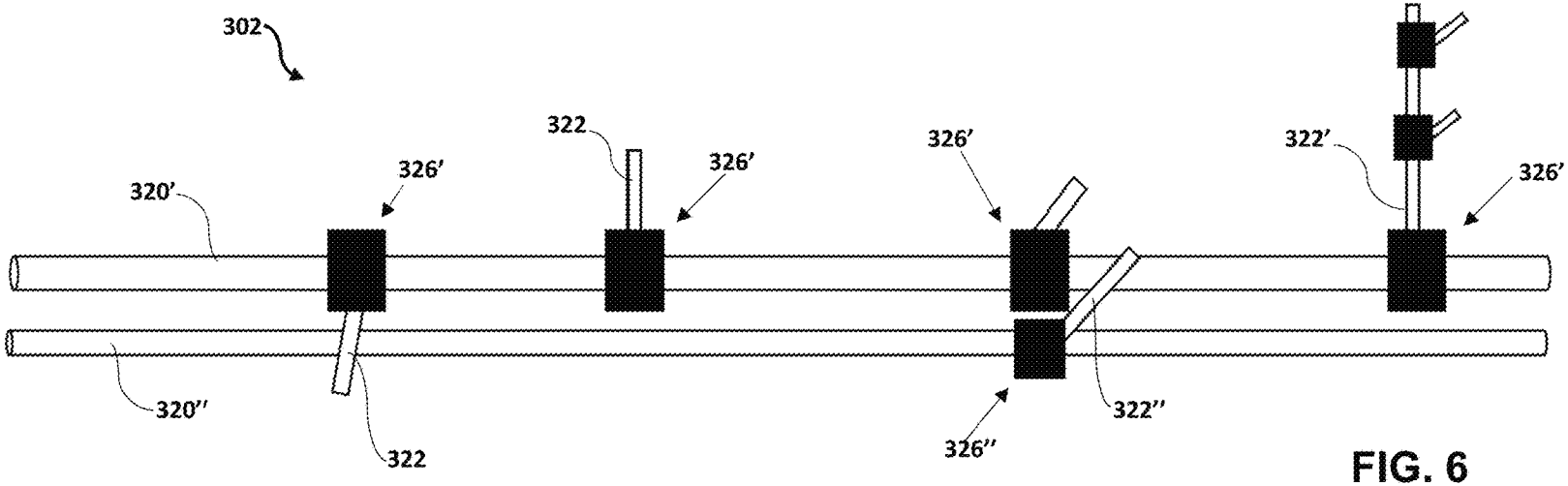
FIG. 6 shows a wiring harness assembly including two main trunk cable lines, and branch and sub-branch cables extending therefrom and connectors therebetween in accordance with a non-restrictive illustrative embodiment of the present disclosure.
Figure 7:
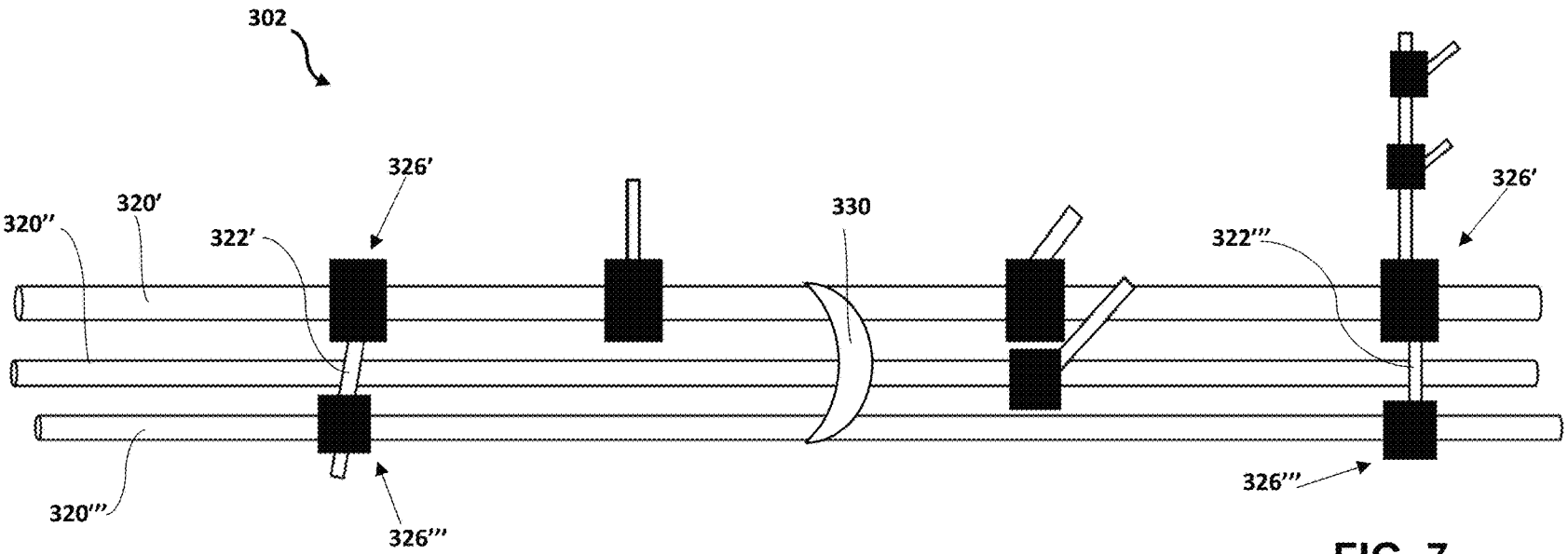
FIG. 7 shows a wiring harness assembly including three main trunk cable lines, and branch and sub-branch cables extending therefrom and connectors therebetween in accordance with a non-restrictive illustrative embodiment of the present disclosure.

FIGS. 5, 6 and 7 show the building of a wiring harness assembly 302 in accordance with a further example. FIG. 5 shows a main trunk cable 320' having been laid down with a plurality of connectors 326' connecting cable portions thereof as well as building branch cables 322' therefrom. FIG. 6 shows a second main trunk cable 320" being running along the same direction as the first cable 320' with a connector 326" mounted thereto and interconnecting portions thereof. A branch 322" extends from the connector 326". FIG. 7 shows a third main trunk cable 320'" running along the same direction as the first cable and second cables 320' and 320" with a connector 326'" connected to a connector 326" via branch cables 322' and with another connector 326''' connected to a connector 326'' via branch cables 322'''. A clamp 330 connects the three main trunk cables 320', 320'', 320''' together.

As such, a variety of single or plural cable and connector type combinations including a variety of different type and number of cable portions along a same trunk or branch can be contemplated within the scope of the present disclosure.

Figure 8A:
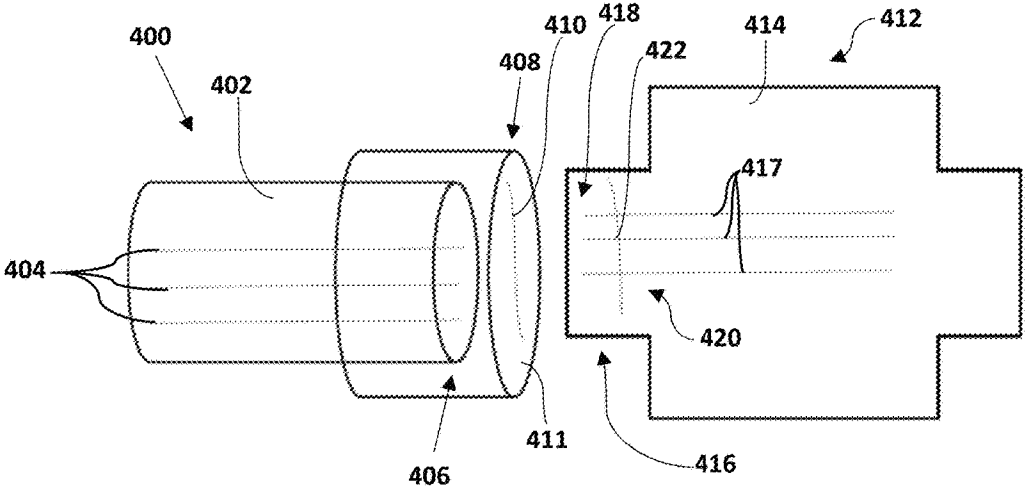
FIG. 8A is schematic representation of a cable and a connector of a wiring harness assembly in a disconnected position in accordance with a non-restrictive illustrative embodiment of the present disclosure.
Figure 8B:
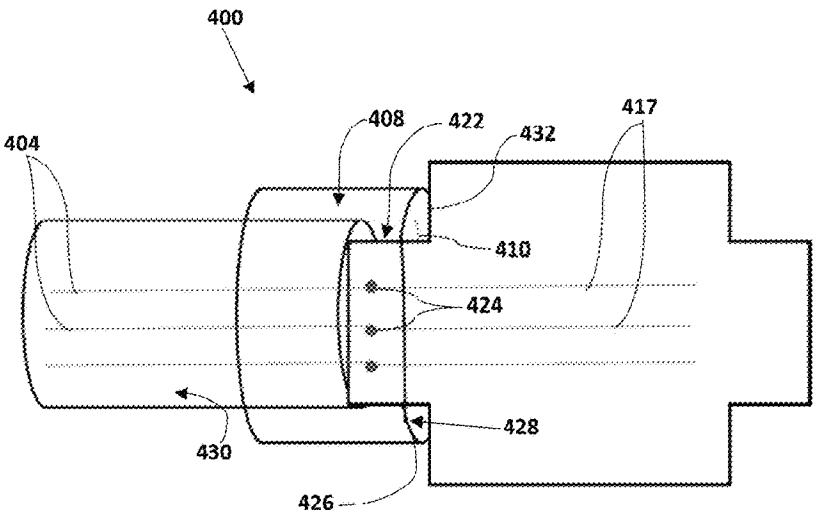
FIG. 8B is a schematic representation of the cable and connector of FIG. 8A in a connected position.

With reference to FIGS. 8A and 8B, the connection between a cable and a connector will be further described in a accordance with a non-restrictive illustrative embodiment of the present disclosure. A cable 400 defines an outer jacket 402 grouping wires 404 therein and defines a terminal end 406 thereof. An enlarged female connecting portion 408 is defined about the terminal end 406 which includes inner mating elements 410 such as threads formed within the inner surface 411 of the female connecting portion 408. A connector 412 includes a main body 414 that provides for arms 416 extending therefrom. An arm 416 houses wires 417 therein and defines a terminal end 418 and defines a male portion 420 including outer mating elements 422 such as threads for mutual interference engagement with threads 410. Accordingly, the male portion 420 is inserted within the female portion 408 such that there is wire-to-wire contact 424 between wires 404 and 417. The female portion 408 defines a rim 426 circumscribing the opening 428 leading to the cable tunnel 430 in which the wires 404 run. This rim 426 is engaged by a shoulder 432 formed at the base of the arm 416 which acts a stopper to the inward movement of the male portion 420.

In an embodiment, the connectors of the disclosure comprise the wire harnessing devices of U.S. patent application Ser. No. 16/983,501. These connectors include an outer housing with main portion and arm or branch portions extending therefrom. The housing houses a wiring harness embedded therein and includes main trunk wires (or wire segments) and branch wires (or wire segments) connected together at connecting points thus defining the wiring harness. The trunk wires (or wire segments) and the branch wires (or wire segments) extend into the arms. The arms define open free ends for allowing electrical (i.e. wire-to-wire) connection to the respective terminal connecting ends for being respectively connected to main trunk wires within main trunk cables and branch wires within branch cables. Thus, the main trunk wires (or wire segments) of the wire harness within the connector have terminal ends that connect to respective terminal end of the main trunk cable and the branch wires (or wire segments) of the wire harness within the connector have terminal ends that connect to branch wires of the branch cables. The connector wire harness thus corresponds to the attachment area 108 and the wire-to-wire connections between the wires (or wire segments) of the connector wire harness and the main trunk cable and branch cables correspond fall within the above-discussed proximal zones of the intersections 128 shown in FIG. 1.

Turning to FIGS. 9, 10A, 10B and 11 various examples of connectors will be described so as to further exemplify the disclosure and not limit the scope thereof.

Figure 9:
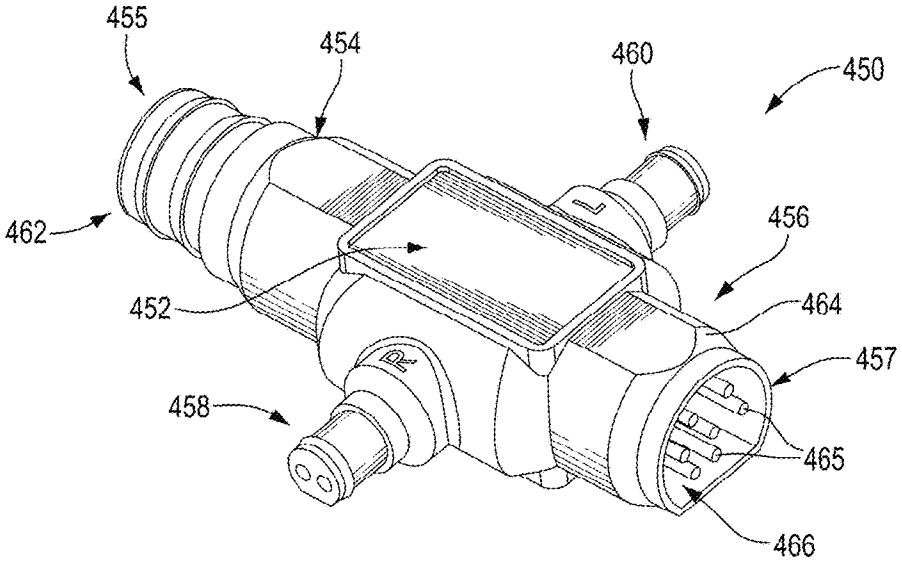
FIG. 9 is a perspective view of a wiring device connector for a wiring harness assembly in accordance with a non-restrictive illustrative embodiment of the present disclosure.

FIG. 9 shows a molded harness connector device 450 comprising a main body 452 and arms 454, 456, 458 and 460 extending therefrom. The device 450 is prepared by the method disclosed in U.S. Ser. No. 16/983,501. Each arm 454, 456, 458 and 460 defines a respective terminal end 455, 457, 459 and 461 respectively for connecting to a cable terminal end for wire end to end connection as provided herein. Arm 454 defines a neck insert 462 with outer threads for mutual interference engagement with a female cable end as explained in FIGS. 8A and 8B. Arm 456 also defines a neck insert 464 without any threaded portion and acts as a plug for a female cable slot. Arms 458 and 460 may also be insertable within the female plug slots. Terminal end 457 shows the ends 465 of wires 466 which connect to cable wires as explained herein.

Figure 10:
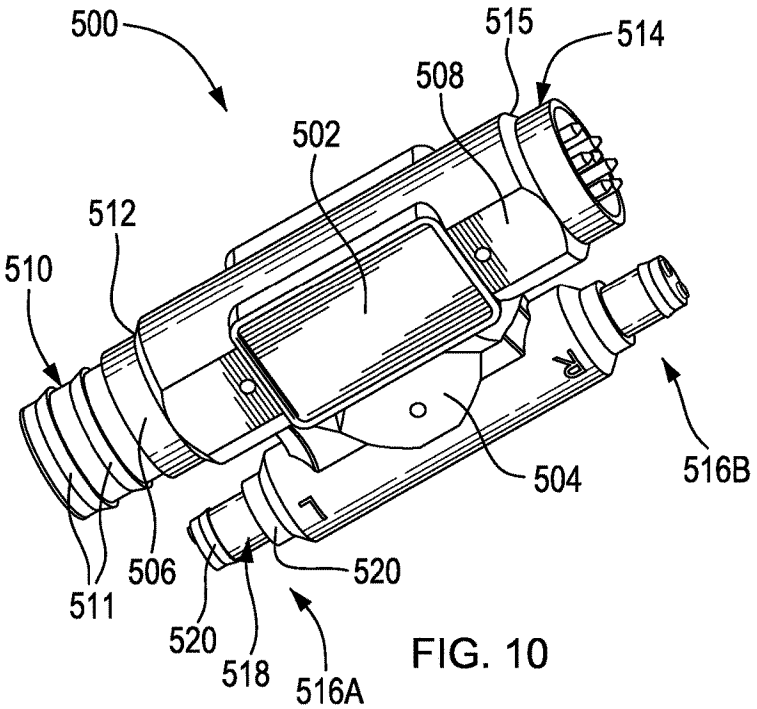
FIGS. 10 is a perspective view of a wiring device connector for a wiring harness assembly in accordance with another non-restrictive illustrative embodiment of the present disclosure.

FIG. 10 shows a molded harness connector 500 prepared by the the method disclosed in U.S. Ser. No. 16/983,501. The connector 500 defines a main body 502 and an auxiliary body 504 extending therefrom. The main body 502 defines a pair of opposite arms 506 and 508. Arm 506 includes a male connecting structure 510 having a plurality of connecting collars 511 thereon for mutual interference engagement with complementary connecting elements within the inner surface of a female connecting structure of a cable. The male connecting structure extends from a shoulder 512 which acts as a stopper to the female cable end. It is the structure 510 that is insertable within the female portion and the rest of the arm 506 is stopped by shoulder 512 engaging the rim of the female cable end. Arm 508 has a slide in plug in male connecting structure 514 extending from a shoulder 515 which engages a female cable rim as previously discussed herein. The auxiliary body 504 defined opposite arms 516A and 516B which also have male connecting structure 518 extending from a stopper collar 520 and including a connecting collar 522 formed about the male connecting structure 518 at the shoulder 512.

Figure 11:
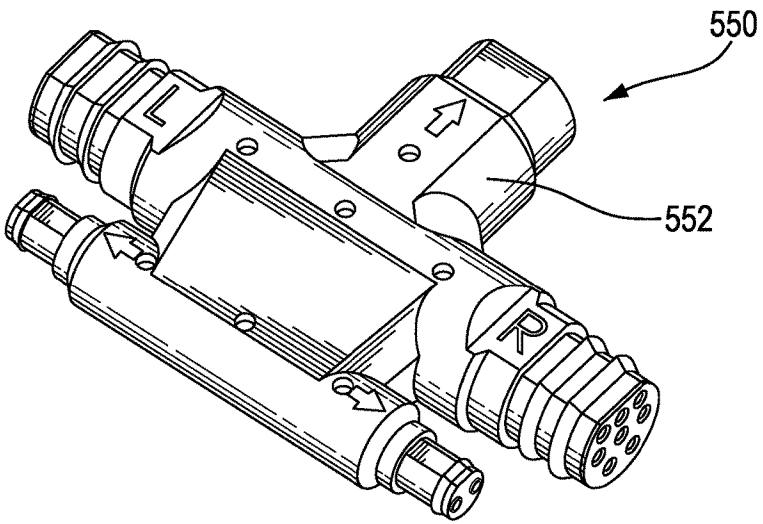
FIG. 11 is a perspective view of a wiring device connector for a wiring harness assembly in accordance with a further non-restrictive illustrative embodiment of the present disclosure.
Figure 12:
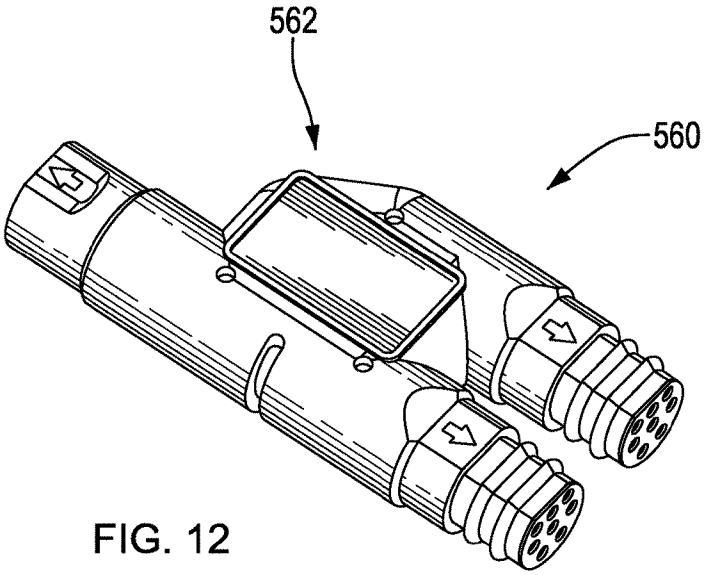
FIG. 12 is a perspective view of a wiring device connector for a wiring harness assembly in accordance with yet another non-restrictive illustrative embodiment of the present disclosure.
Figure 13:
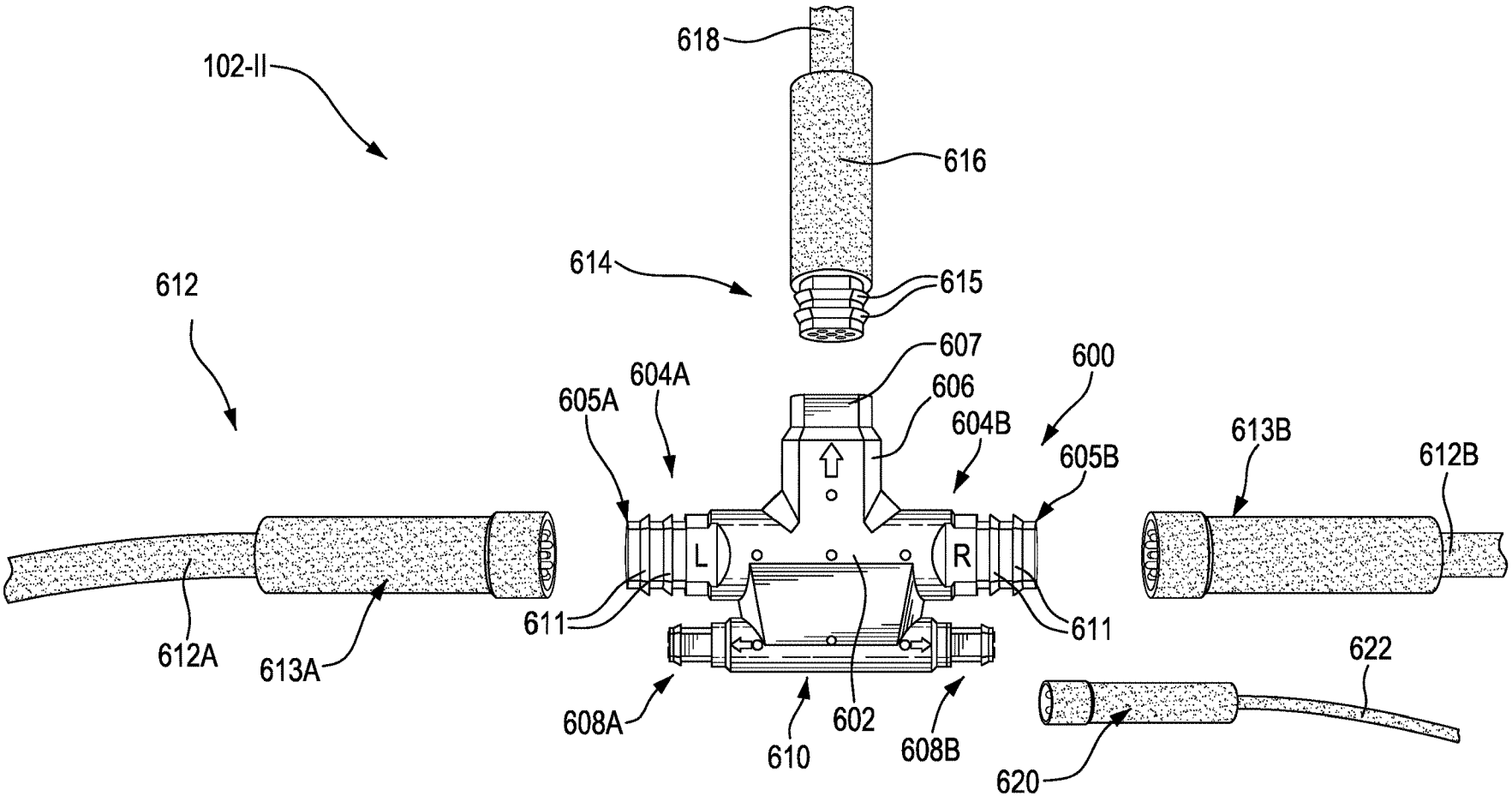
FIG. 13 shows a wiring harness assembly including a wiring device connector and main trunk and branch cable connectors in a disconnected position in accordance with a non-restrictive illustrative embodiment of the present disclosure.

FIGS. 11 and 13 show other connector devices 550 and 560 respectively having similar main bodies 552 and 562 and arms as described hereinabove with structures that are similar to the previously described structures and need not be further described herein for concision purposes only.

The connecting arms of the connector devices can be connected to cables for wire-to-wire connection therewith in a variety of male-female structural configurations as will be appreciated by the skilled artisan and the specific examples illustrated and described herein are only for the purposed of exemplifying the disclosure and by no means of limiting the scope thereof. The arms or sleeves or branches of the connectors may indeed be female portions for receiving cable make portions therein as will be easily contemplated by the skilled artisan. Indeed, the reason for the connection between a connector and a cable is for wire-to-wire contact. Indeed, the cables of the disclosure whether forming part of the main trunk or of a branch or sub-branch of the wiring diagram on which the wiring harness assembly is based on may include integrated end connectors for being connected to the branch connector devices described herein and/or other cables.

Keeping the above in mind and with reference to FIG. 13 a further example of a wire harness assembly 102-II will be described to further exemplify the disclosure.

The assembly 102-II includes a connector 600 having a main body 602 defining a pair of opposite axial arms 604A and 604B a top arm 606 and a pair of opposite axial arms 608A and 608B extending from an auxiliary part 610 depending from the main body 602. The arms 604A and 604B define male portions 605A and 605B with collars 611 formed thereon. Main trunk cables 612A and 612B are connected to the connector 600 positioned therebetween along the same axis formed by the arms 604A and 604B defining a main trunk cable assembly 612 when interconnected therewith. Cable 612A defines an enlarged female connecting portion 613A for receiving the male portion 605A therein. Cable 612B defines an enlarged female connecting portion 613B for receiving the make portion 605B therein. The top arm 606 defines a female connecting socket 607 for receiving the male insert portion 614 of an enlarged male portion 616 of a branch cable 618. The portion 614 has connecting collars 615 formed therein. The arms 608A and 608B can be plugged into the female sockets 620 of branch cables 622.

Figure 14A:
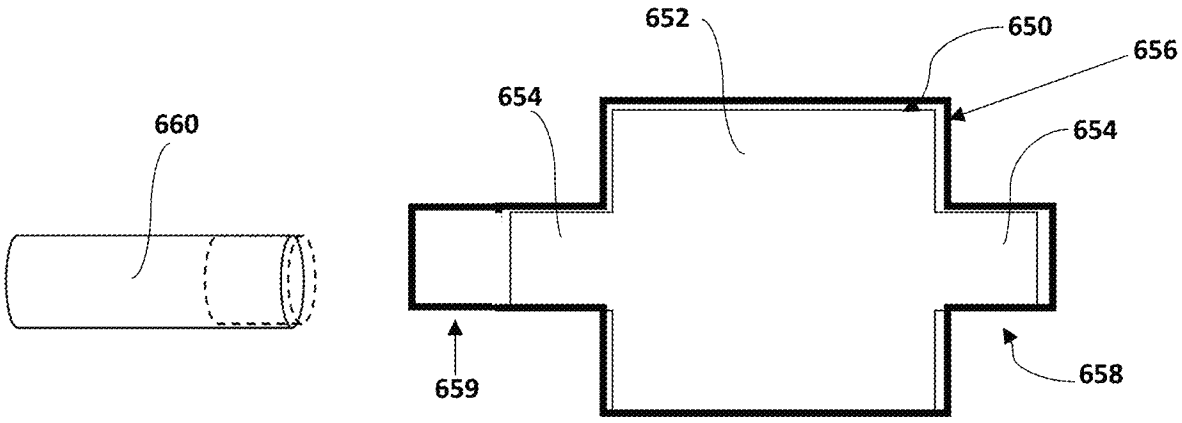
FIG. 14A is a schematic representation of a heat shrinking molded connector and a cable of a wiring harness assembly in a disconnected position in accordance with a non-restrictive illustrative embodiment of the present disclosure.
Figure 14B:
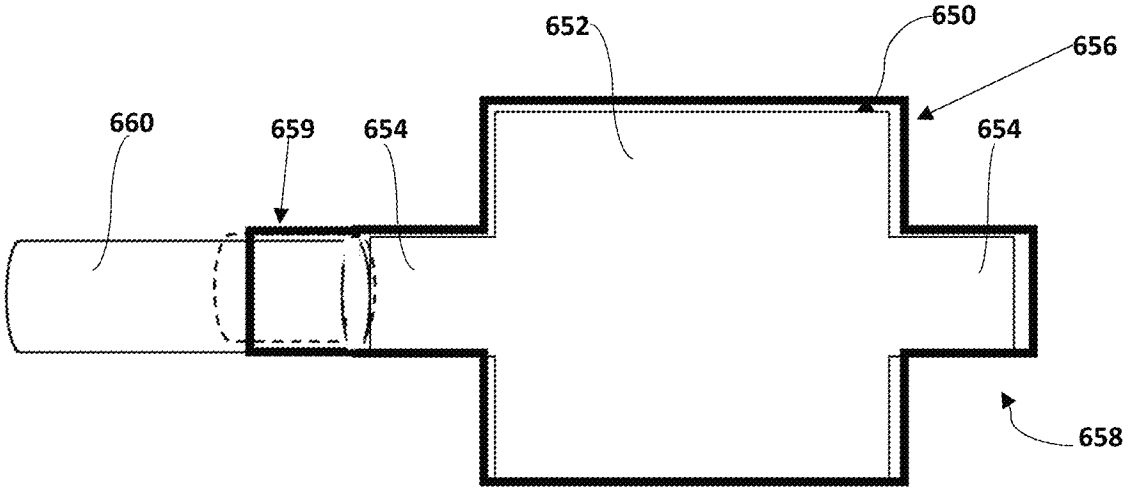
FIG. 14B is a schematic representation of the heat shrinking molded connector and the cable of FIG. 14A in a connected position.

With respect to FIGS. 14A and 14C, the heat shrinking molded connector of the wiring harness assemblies of the disclosure will now be described in accordance with a non-limiting embodiment provided herein as an example.

A connector 650 including main body 652 and arms 654 is covered by a hear shrinking tubular covering 656 that is molded to have a similar outer shape as the connector 650 for heat shrinking thereon providing the heat shrinking molded connector structure 658. The structure 658 defines a sleeve 659 formed by the tubing 656 which provides for receiving a cable 660 therein for the cable connector connection disclosed herein. The sleeve 659 is then mounted thereto via heat shrinking providing a water-tight connection between the cable 660 and the connector 650.

Figure 16:
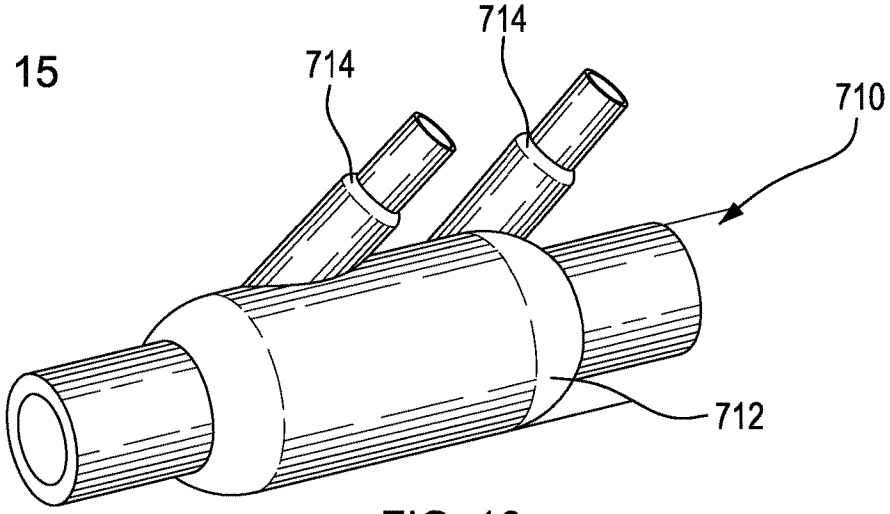
FIG. 16 is a perspective view of a heat shrinking tube of a wiring harness assembly in accordance with another non-restrictive illustrative embodiment of the present disclosure.
Figure 15:
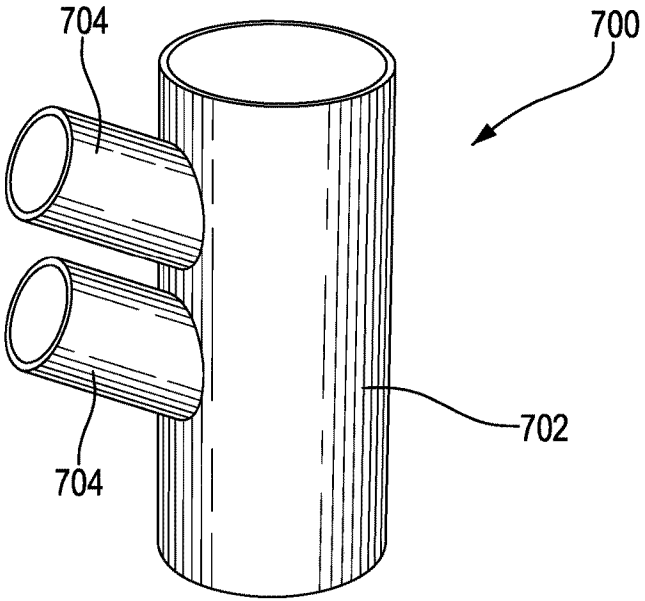
FIG. 15 is a perspective view of a heat shrinking tube of a wiring harness assembly in accordance with a non-restrictive illustrative embodiment of the present disclosure.

With reference to FIGS. 15 and 16, heat shrinking tubes 700 and 710 are shown. The tubes 700 and 710 are shown including main trunk sleeves 702 and 712 respectively as well as branch sleeves 704 and 714 respectively. Of course, the heat shrinking tubes of the present disclosure can be provided in a variety of suitable configurations depending on the shape of the particular wire harness assembly connection on which the heat shrinking tube is being mounted to for water-tight sealing.

Figure 17:
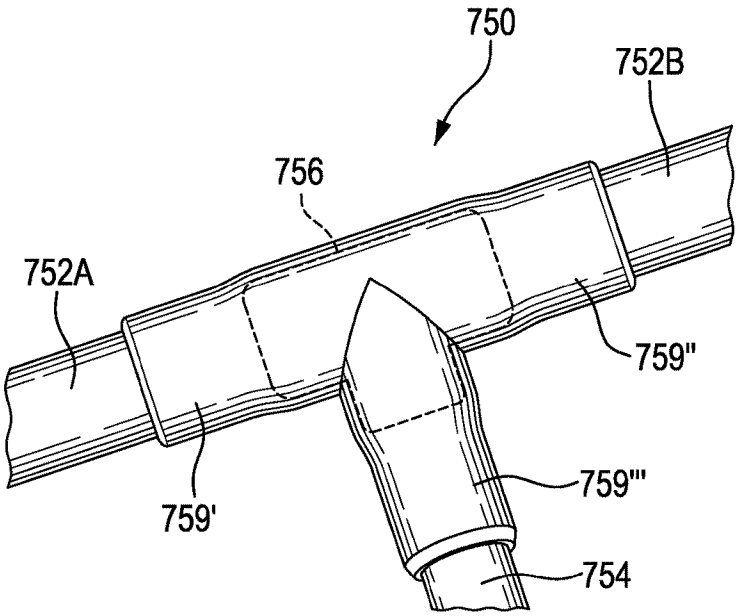
FIG. 17 is a perspective view of a portion of a wiring harness assembly showing a heat shrinking tube fitted onto an interconnection of a connector and cables in accordance with a non-restrictive illustrative embodiment of the present disclosure.

FIG. 17 shows a particular connection 750 of a wire harness assembly having a pair of main trunk cables 752A and 752B interconnected with a a branch cable 754 running along a perpendicular pathway relative to the main trunk. This interconnection is provided by a molded connector 756 covered by a heat shrinking tube 758. The heat shrinking tube includes sleeves 759', 759", and 759'" for covering the connecting ends of cables 752A, 752B and 754 thereby providing a water-tight seal for connection 750. In order to remove one of the cables or the connector from the connection 750, the user would need to heat the tube 758 so as to cut it and remove it from connection 750 allowing disconnection of the interconnected components as provided herein.

Figure 18A:
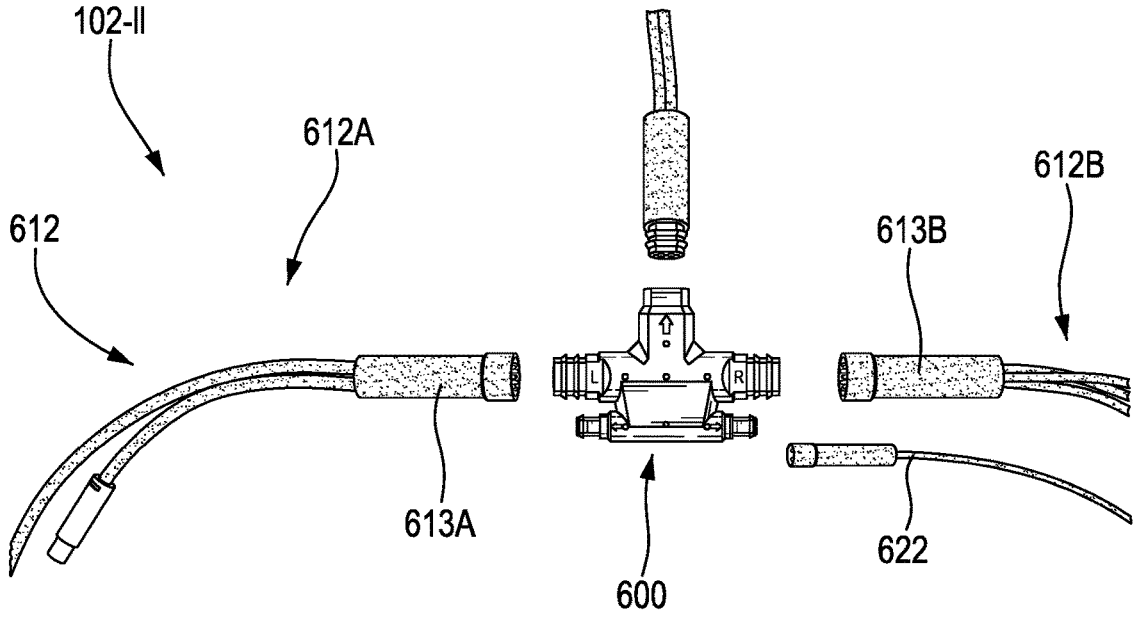
FIG. 18A shows a wiring harness assembly including a connector and cables in a disconnected portion in accordance with a non-restrictive illustrative embodiment of the present disclosure.
Figure 18B:
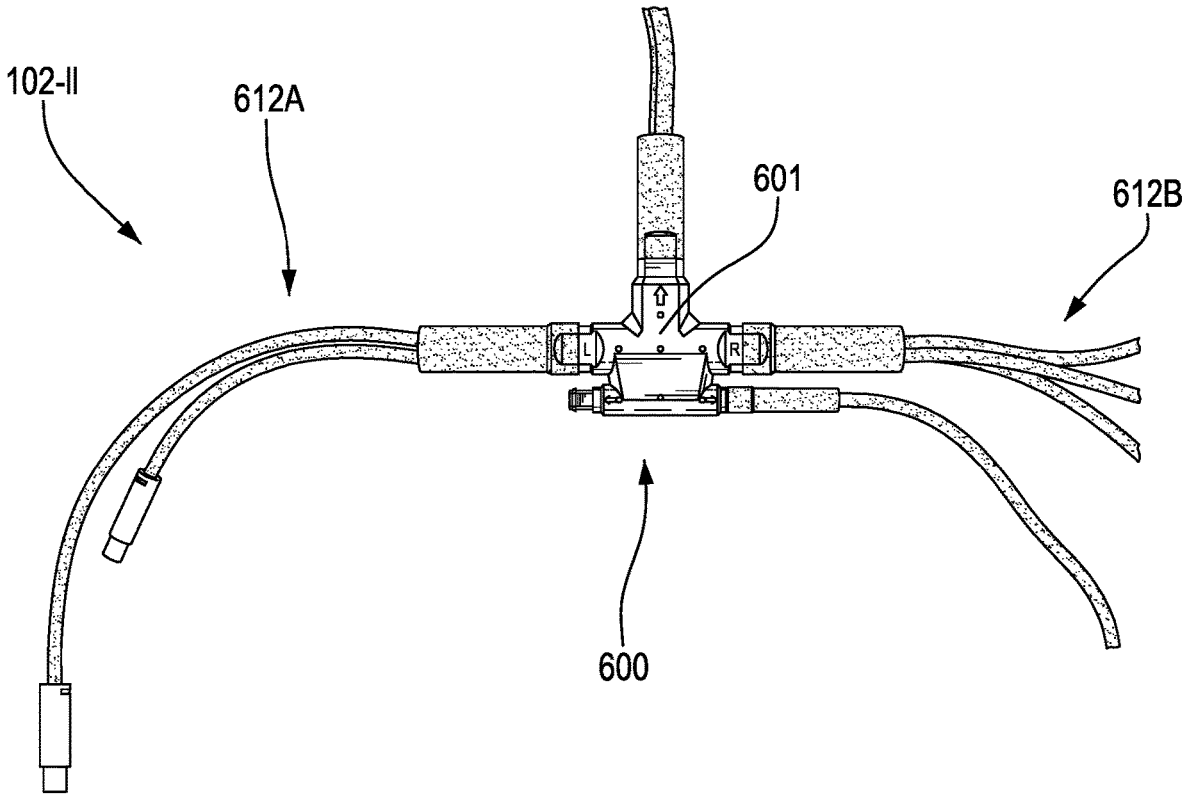
FIG. 18B shows the connector and cables of FIG. 19A with a heat shrinking tube mounted thereto.

Turning now to FIGS. 18A and 18B a further example of heat shrinking molded connector will be described. FIG. 18A shows the arrangement of wire harness assembly 102-II described at FIG. 13 which is in the disconnected position. FIG. 18B shows this same arrangement in a connected position. The assembly 102-II includes the connector 600 with main trunk cables 612A and 612B for being connected thereto with the connector 600 positioned therebetween along the same axis defining a main trunk cable assembly 612 when interconnected. A branch cable 618 is also connectable to the connector 600. Cables 612A, 612B and 618 are connected to the connector 600 and this interconnection is sealed via a heat shrinking tube 601 heat sealed thereon so as to cover the connector 600 as well as the connecting portions of the cables 612A, 612B, 618 and 622 previously described for water-tight sealing.

Figure 19B:
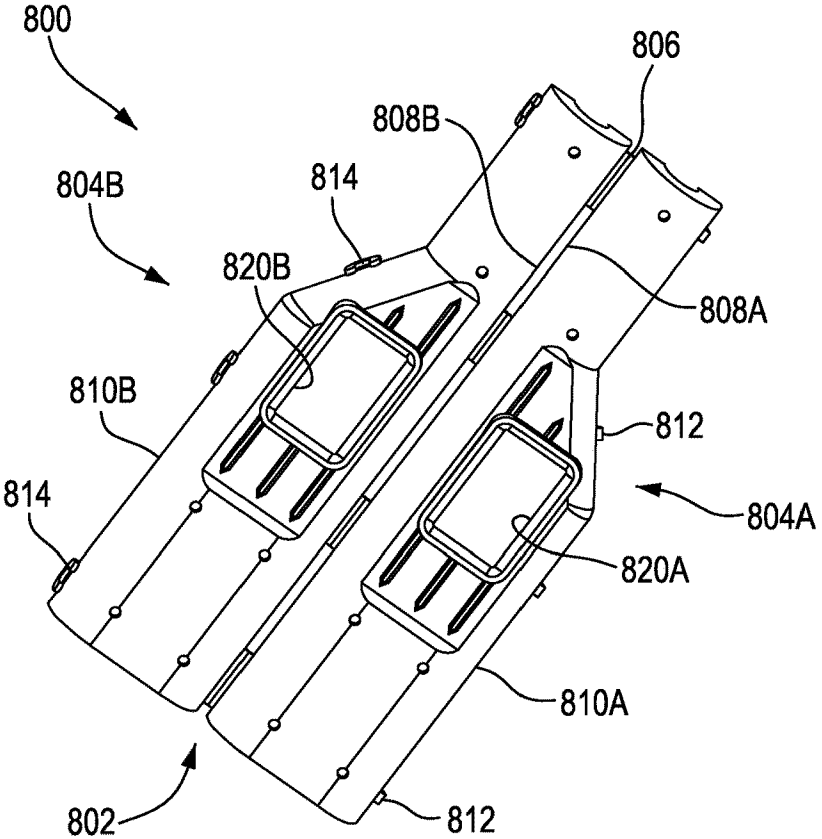
FIG. 19B is another perspective view of the locking system of FIG. 19A.
Figure 19A:
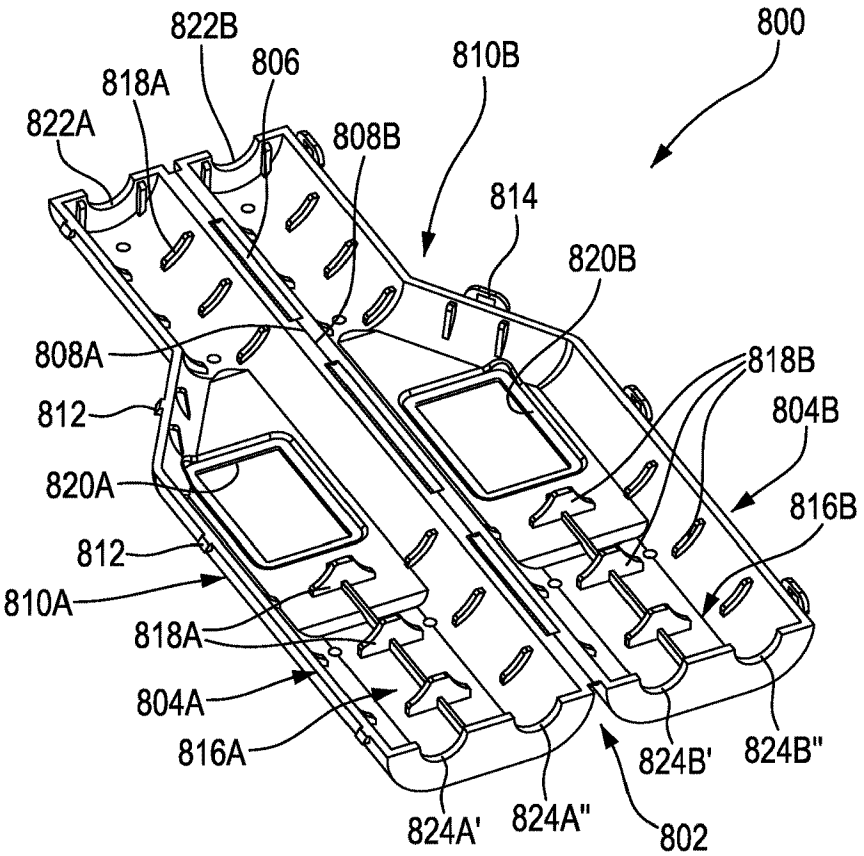
FIG. 19A is a perspective view of a locking system for a molded wiring connector for a wiring harness assembly in accordance with a non-restrictive illustrative embodiment of the present disclosure.

FIGS. 19A and 19B show a clamping device 800 for releasably clamping connector and cable connections of the wire harness assemblies disclosed herein. The clamping devices herein provide the locking system as will be further detailed below.

The clamping device 800 of the present non-limiting example includes a shell body 802 with a pair of body parts 804A and 804B hinged together at hinges 806 at respective interconnected sides 808A and 808B for opening and closing the body parts 804A and 804B. The respective opposite free sides 810A and 810B of the body parts 804A and 804B include respective and complementary locking elements such as protrusion tabs 812 and groove tabs 814 for snap fit locking. The configuration of the camping device 800 is molded in accordance with the shape of the connector and interconnected cables it will clamp lock as will be further described herein. The body parts 804A and 804B comprise respective inner sides 816A and 816B having respective ridges 818A and 818B for positioning cables therebetween. The body parts 804A and 804B also have windows 820A and 820B for exposing a connector clamped thereby. The foregoing is convenient when connectors are marked with indicia such as color codes as previously described. The body parts 804A and 804B include respective first end opening halves 822A and 822B that when joined form an opening for cables to pass therethrough. Body part 804A also has respective second end opening halves 824A' and 824A" that are respectively joined by the second end opening halves 824B' and 824B" to form a pair of second end openings for cables to pass therethrough.

Figure 20A:
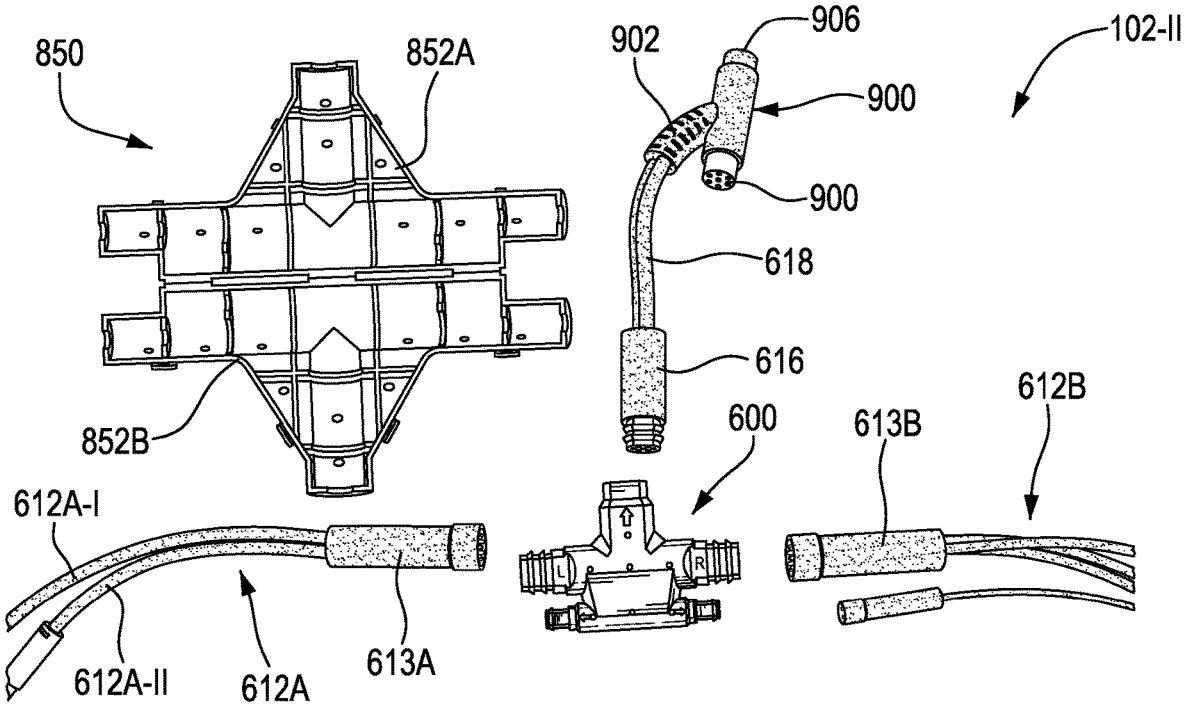
FIG. 20A shows a wiring harness assembly in disconnected position including a wiring device connector, a locking system in an open position and cables in accordance with a non-restrictive illustrative embodiment of the present disclosure.
Figure 20B:
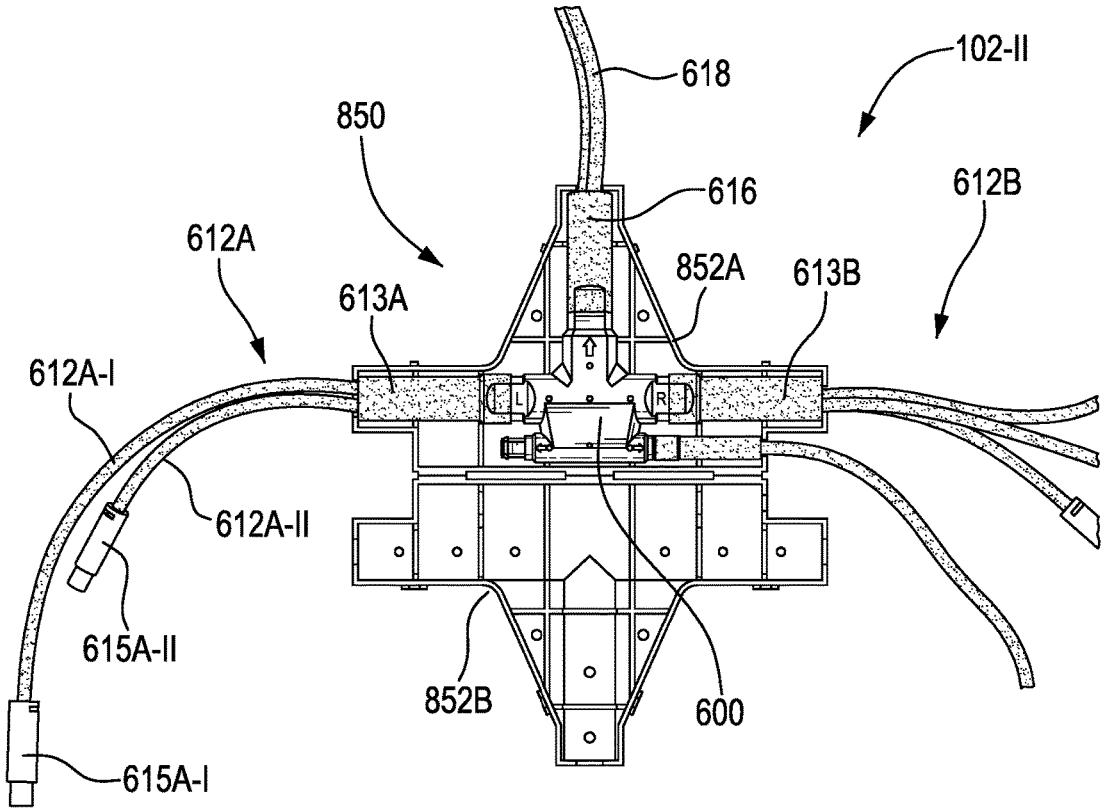
FIG. 20B shows the wiring harness assembly of FIG. 20A in a connected position with the locking system in an open position.
Figure 20C:
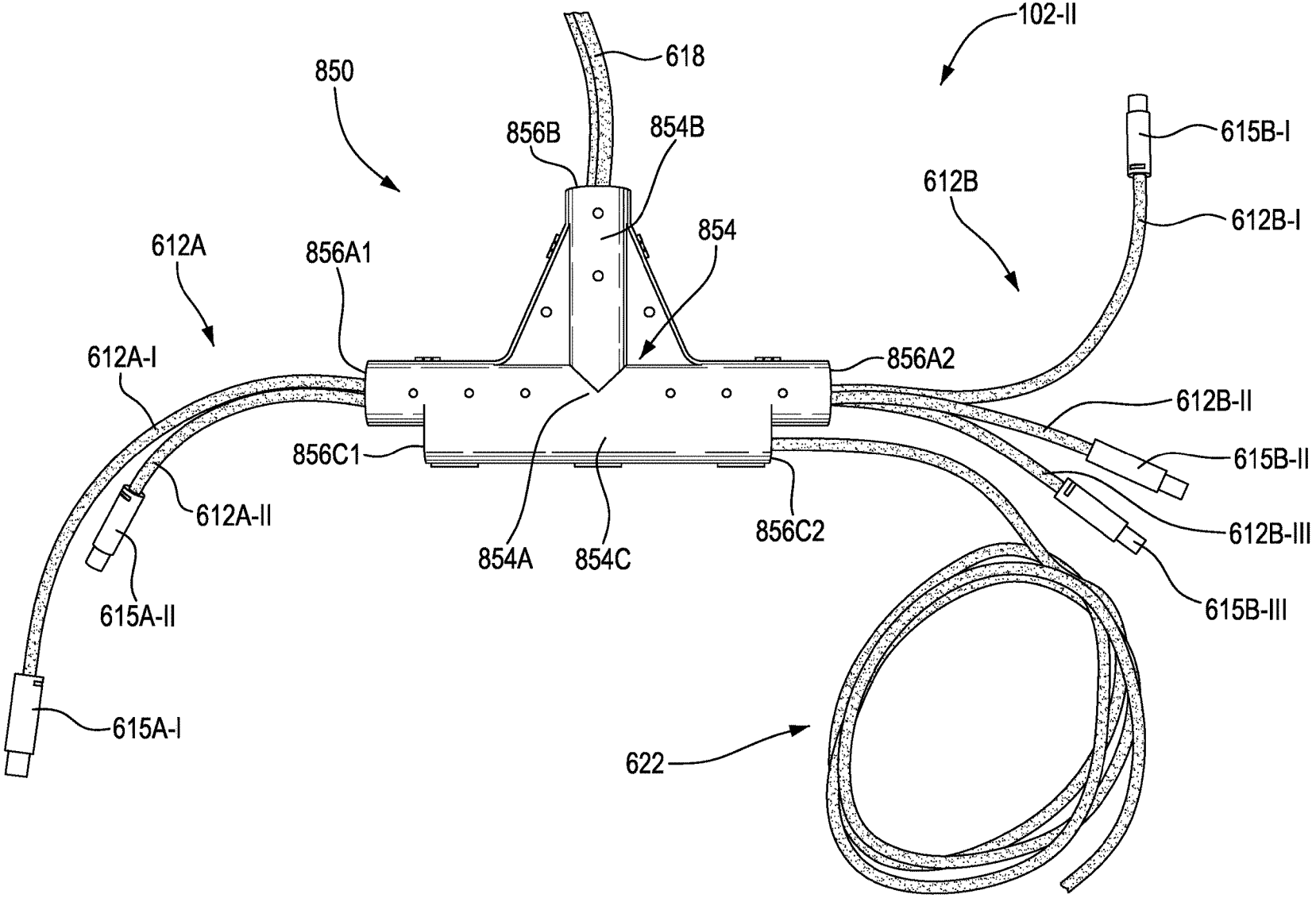
FIG. 20C shows the wiring harness assembly of FIG. 20B with the locking system in a closed position.

With reference to FIGS. 20A, 20B and 20C, the mounting of a clamping device 850 to the connection shown by the arrangement of wire harness assembly 102-II previously described at FIGS. 13, 18A and 18B. The device 850 include a pair of body parts 852A and 852B forming two halves of tubular T-structure 854 when closed to lock therein the cables 612A, 612B and 618 and connector 600 when connected thereto. The tubular T-structure 854 includes main trunk tube portion 854A, a branch tube portion 854B extending from and being perpendicular to portion 854A, branch tube portion 854C extending from and running parallel to portion 854A. Tube portion 854A defines opposite openings 856A1 and 856A2 for cables 612A and 612B respectively to extend outwardly therefrom. Tube portion 854B defines opening 856B for cable 618 to outwardly extend therefrom. Tube portion 854C defines opposite openings 856A1 and 856A2 for a cable 622 to outwardly extend therefrom.

With reference to FIGS. 13, 18A-18B, and 20A-20C, cable 612A comprises two cables 612A-I and 612A-II having a common female connecting terminal end 613A at one common end thereof but separate respective connector terminal ends 615A-I and 615A-II, respectively, at the opposite ends thereof. The cable 612B comprises three cables 612B-I, 612B-II, 612B-III having a common female connector terminal end 613B thereof but separate respective connector terminal ends 615B-I, 615B-II and 615B-III. The cable 618 has an integrated connector 900 at is end 902 opposite its male portion 616 connection end. Connector 902 is a cylindrical member with two opposite connecting terminal ends 904 and 906. Connecting end 904 is a male structure, whereas connecting terminal end 906 is a female structure.

Figure 21A:
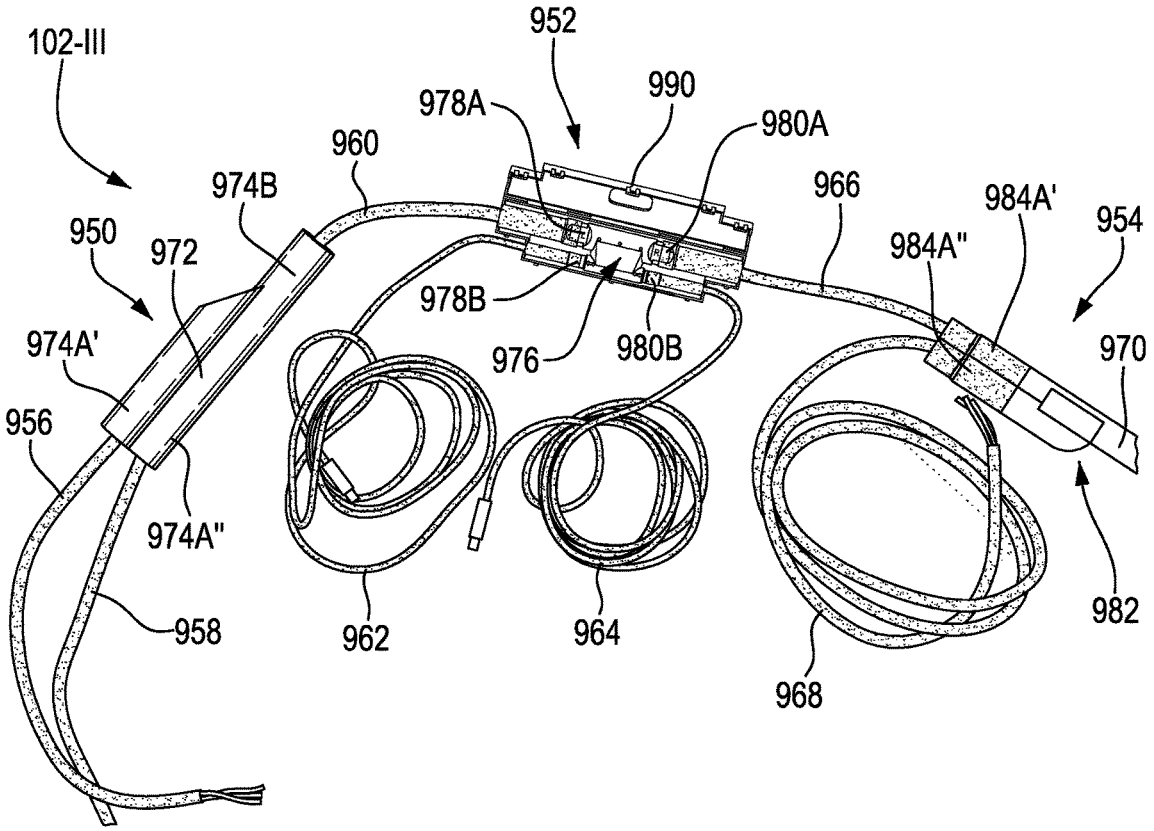
FIG. 21A shows a wiring harness assembly in a connected position including a wiring device connector with a locking system in an open position mounted thereto and wiring device connectors and cables with heat shrinking tube mounted thereto accordance with a non-restrictive illustrative embodiment of the present disclosure.
Figure 21B:
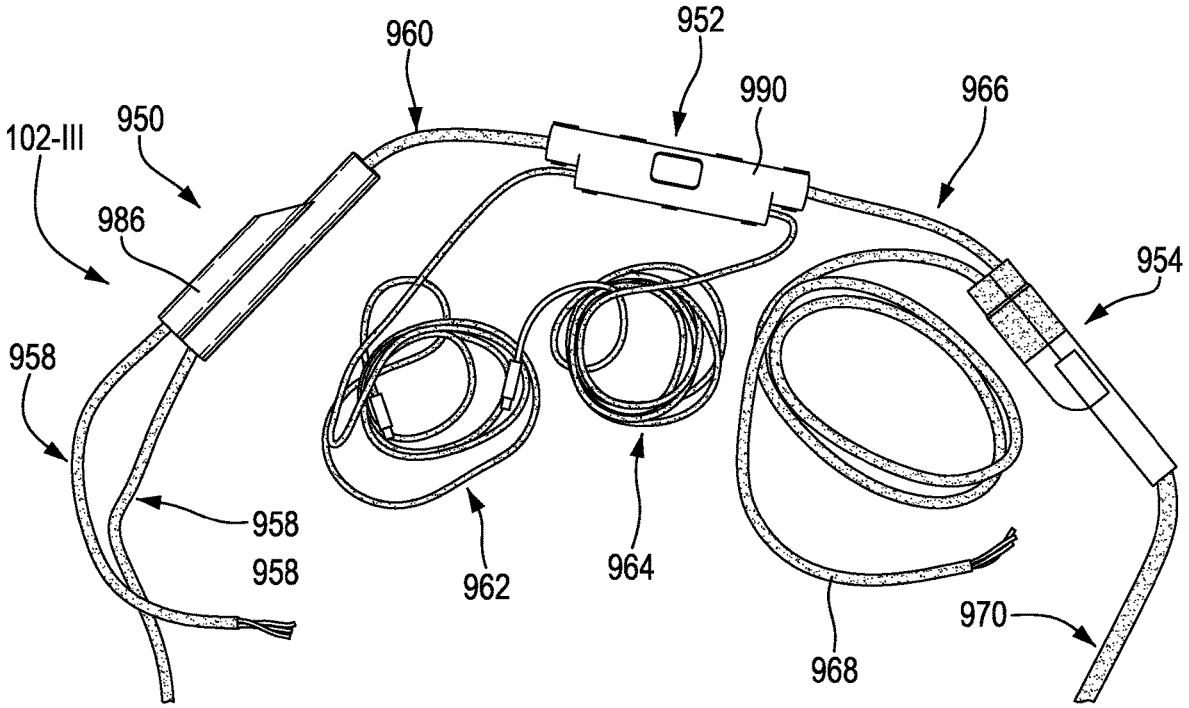
FIG. 21B shows the wiring harness assembly of FIG. 21A with the locking system in a closed position.

FIGS. 21A and 21B show a wiring harness assembly 102-III in accordance with another non-limiting illustrative embodiment of the present disclosure including three connection area 950, 952, and 954 between cables 956, 958, 960, 962, 964, 966, 968 and 970. Connection area 950 includes a connector 972 having a pair of arms 974A', 974A" extending from end thereof to respectively connect with cables 956 and 958 and another arm 974B at the opposite end that connects with cable 960. Connection area 952 includes a connector 976 having a pair of first opposite end arms 978A and 978B and a pair of second opposite end arms 980A and 980B. Cable 960 is connected to arm 978A and cable 962 is connected to arm 980A. Cable 964 is connected to arm 980B and cable 966 is connected to arm 980A. Connection area 954 includes a connector 982 having a pair of arms 984A', 984A" extending from end thereof to respectively connect with cables 966 and 968 and another arm 984B at the opposite end that connects with cable 970. Connector 972 and the connecting ends of the cables connected thereto as previously discussed have been heat sealed via a heat shrinking tube covers 986 for a water-tight fit. Connector 976 and the connecting ends of the cables connected thereto as previously discussed have been clamped together via the clamp device 990 shown in FIG. 21A in an open position and in FIG. 21B in a closed position.

Figure 22A:
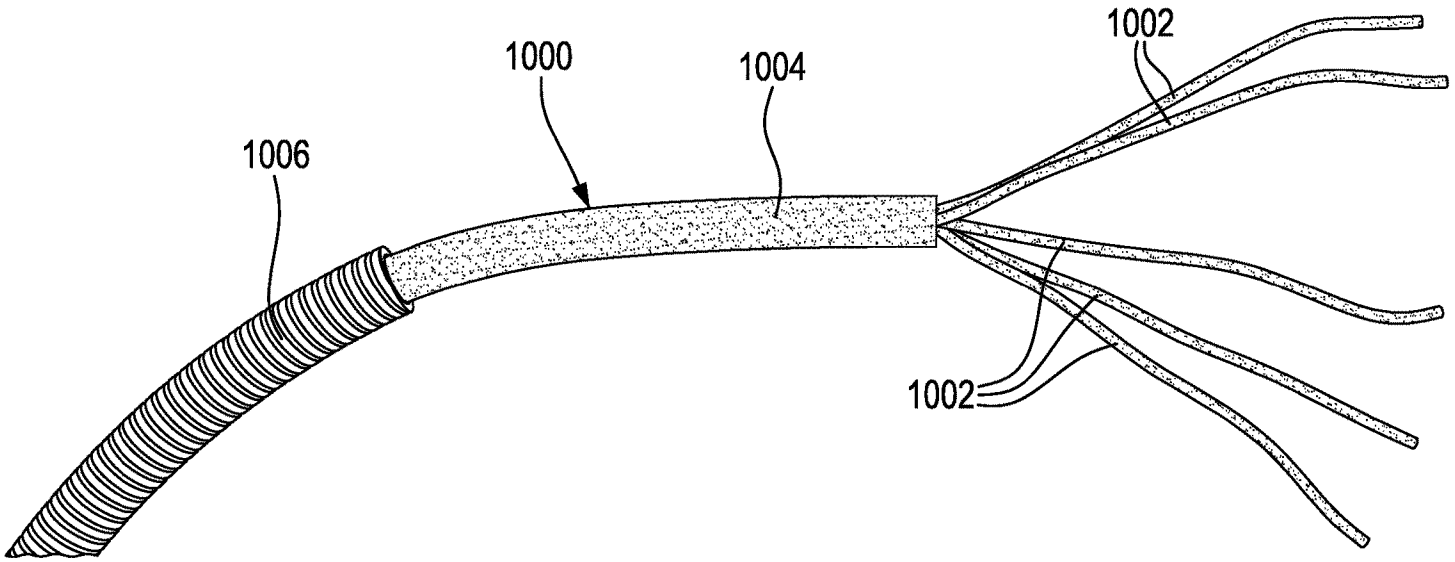
FIGS. 22A and 22B show a cable of a wiring harness assembly in accordance with a with a non-restrictive illustrative embodiment of the present disclosure.
Figure 22B:
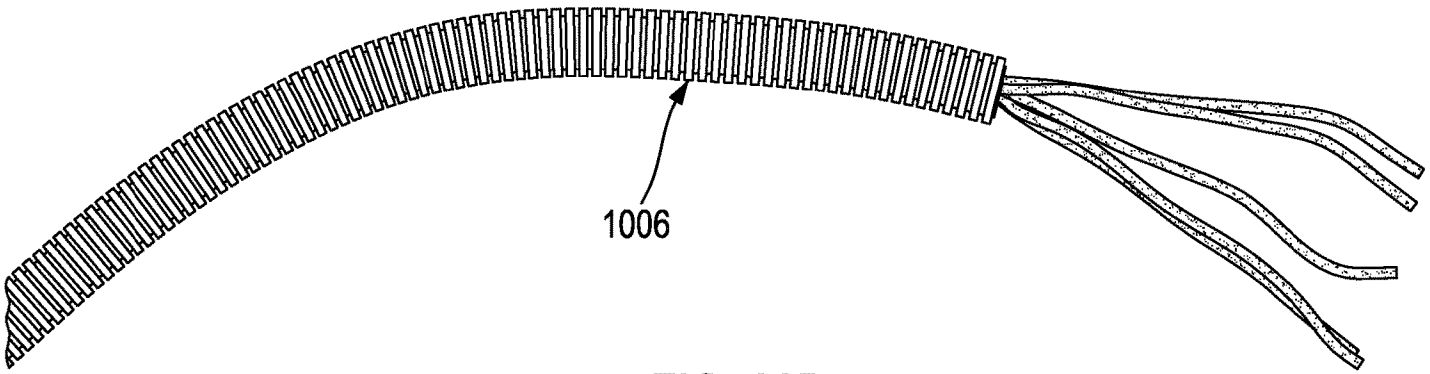

With respect to FIGS. 22A and 22B, a cable 1000 of a wire harness assembly as provided herein includes one or more wires 1002 covered by a jacket 1004. As previously mentioned, one or more such cables 1000 as well as in some cases or more additional wires 1002 without jackets 1004 can be covered by an extruded outer jacket 1006. In an embodiment, the external jacket 1006 is a corrugated covering, the corrugations can be provided in various configurations including circular corrugations or square corrugations. Thus jacket 1006 is integrated onto the cable and/or wire combination it covers providing a protective water-tight seal as well as forming a single convenient piece as previously explained. The corrugated covering provides strength and flexibility.

The various features described herein can be combined in a variety of ways within the context of the present disclosure so as to provide still other embodiments. As such, the embodiments are not mutually exclusive. Moreover, the embodiments discussed herein need not include all of the features and elements illustrated and/or described and thus partial combinations of features can also be contemplated. Furthermore, embodiments with less features than those described can also be contemplated. It is to be understood that the present disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been provided hereinabove by way of non-restrictive illustrative embodiments thereof, it can be modified, without departing from the scope, spirit and nature thereof and of the appended claims.

What is claimed is:

1. A wiring harness assembly comprising:

a main trunk cable assembly defining opposite terminal ends thereof and comprising main trunk wires;

a branch cable assembly defining opposite terminal ends thereof and comprising branch wires; and at least one connector for connecting the main trunk cable assembly and the branch cable assembly, the connector comprising a housing and an inner wiring harness positioned within the housing, the housing defines a main portion and arm portions extending therefrom defining free ends, the inner wiring harness comprising main trunk wire segments and branch wire segments interconnected at mutual connecting points thereof, the main trunk wire segments defining terminal ends thereof positioned at respective ones of the free ends of the arm portions for being connected to the main trunk wires at one of the terminal ends of the main trunk cable assembly, the branch wire segments defining terminal ends thereof positioned at respective ones of the free ends of the arm portions for being connected to the branch wires at one of the terminal ends of the branch cable assembly, wherein the connector and the respective terminal ends of the of the main trunk cable assembly and the branch cable assembly connected thereto are further connected by a clamping device comprising a shell body defining a pair of hinged body parts releasably connectable together for locking therebetween the respective terminal ends and the connector.

2. The wiring harness assembly according to claim 1, wherein the connector and the respective terminal ends of the of main trunk cable assembly and the branch cable assembly connected thereto are sealed together by a heat shrinking tube.

3. The wiring harness assembly according to claim 1, wherein the main trunk cable assembly comprises at least two separate main trunk cable portions, each of the main trunk cable portions defining respective terminal ends thereof and comprising respective ones of the main trunk wires, the connector providing for connecting the at least two main trunk cable portions, the main trunk wire segments defining opposite ones of the terminal ends thereof for being respectively connected to the main trunk wires of each of the main trunk cable portions at respective terminal ends thereof.

4. The wiring harness assembly according to claim 3, wherein the main trunk cable assembly further comprises a plurality of the separate main trunk cable portions and a plurality of the connectors, at least one of the connectors of the plurality being positioned between a pair of adjacent main trunk cable portions for interconnection therewith.

5. The wiring harness assembly according to claim 4, wherein the plurality of separate main trunk cable portions and the plurality of the connectors are coded with indicia for indicating a position thereof within the wiring harness assembly.

6. The wiring harness assembly according to claim 1, wherein the branch cable assembly further comprises at least two separate branch cable portions, each of the branch cable portions defining respective terminal ends thereof and comprising respective ones of the branch wires, the connector providing for connecting the at least two branch cable portions, the branch wire segments defining opposite ones of the terminal ends thereof for being respectively connected to the branch wires of each of the branch cable portions at respective terminal ends thereof.

7. The wiring harness assembly according to claim 6, wherein the branch cable assembly further comprises a plurality of the separate branch cable portions and a plurality of the connectors, at least one of the connectors of the plurality being positioned between a pair of adjacent branch cable portions for interconnection therewith.

8. The wiring harness assembly according to claim 7, wherein the plurality of separate branch cable portions and the plurality of the connectors are coded with indicia for indicating a position thereof within the wiring harness assembly.

9. The wiring harness assembly according to claim 1, wherein the main trunk cable assembly comprises a plurality of aligned main trunk cables running along a same pathway.

10. The wiring harness assembly according to claim 1, wherein the branch cable assembly comprises a plurality of aligned branch cables running along a same pathway.

11. The wiring harness assembly according to claim 1, wherein at least one of the main trunk cable assembly and the branch cable assembly comprises at least a part thereof an external corrugated jacket integrated thereto.

* * * * *